US012698620B2

(12) United States Patent
Hymas et al.

(10) Patent No.: US 12,698,620 B2
(45) Date of Patent: Aug. 4, 2026

(54) WEAR MEMBER ASSEMBLY WITH COLLARED FASTENING ASSEMBLY

(71) Applicant: Hensley Industries, Inc., Dallas, TX (US)

(72) Inventors: David M. Hymas, Addison, TX (US); Sean M. Pitts, Mesquite, TX (US)

(73) Assignee: Hensley Industries, Inc., Dallas, TX (US)

( * ) Notice: Subject to any disclaimer, the term of this patent is extended or adjusted under 35 U.S.C. 154(b) by 547 days.

(21) Appl. No.: 18/189,515

(22) Filed: Mar. 24, 2023

(65) Prior Publication Data

US 2023/0323639 A1 Oct. 12, 2023

Related U.S. Application Data

(60) Provisional application No. 63/329,794, filed on Apr. 11, 2022.

(51) Int. Cl.
*E02F 9/28* (2006.01)

(52) U.S. Cl.
CPC ..... *E02F 9/2841* (2013.01); *E02F 9/2825* (2013.01); *E02F 9/2833* (2013.01)

(58) Field of Classification Search
CPC ..... E02F 9/2841; E02F 9/2825; E02F 9/2833; E02F 9/2883; E02F 9/2891; E02F 9/2808
See application file for complete search history.

(56) References Cited

U.S. PATENT DOCUMENTS 6,729,052 B2 5/2004 Ollinger, IV
6,959,506 B2 11/2005 Adamic
(Continued)

FOREIGN PATENT DOCUMENTS

AU 2022215294 A1 * 9/2022 ..... E02F 9/2825
CN 103649427 A 3/2014
(Continued)

OTHER PUBLICATIONS

International Searching Authority, International Search Report and Written Opinion of the International Searching Authority, International Application No. PCT/US23/17327, May 22, 2023, 21 pages, ISA/US.

(Continued)

*Primary Examiner* — Christopher J Sebesta
*Assistant Examiner* — Blake E Scoville
(74) *Attorney, Agent, or Firm* — Haynes and Boone, LLP

(57) ABSTRACT

A fastening assembly may comprise a collar and a pin. The collar may have an aperture, a collar lock, which projects from an outer surface, and a pin lock, which is disposed on a portion of the aperture. The collar lock may be compressible and configured to elastically deform while introducing the collar to a wear member. The pin may have a pin lock engagement hole shaped to engage with the pin lock as it is inserted through the aperture of the collar. The fastening system may be used in a wear member assembly. The wear member may have a side opening in communication with a cavity formed on one end of the wear member. The side opening may have a collar lock engagement hole. The collar may be inserted into the side opening so that the collar lock engages the collar lock engagement hole. Methods and assemblies thereof.

15 Claims, 15 Drawing Sheets

(56) References Cited

U.S. PATENT DOCUMENTS

| | | | | |
|---|---|---|---|---|
| 6,986,216 | B2 | 1/2006 | Emrich | |
| 7,080,470 | B2 | 7/2006 | Jones | |
| 7,165,347 | B2 | 1/2007 | Ollinger, IV | |
| 7,299,570 | B2 | 11/2007 | Emrich | |
| 7,451,558 | B2 | 11/2008 | Jones | |
| 7,536,811 | B2 | 5/2009 | McClanahan | |
| 7,640,684 | B2 | 1/2010 | Adamic | |
| 7,640,685 | B2 | 1/2010 | Emrich | |
| 7,730,645 | B2 | 6/2010 | Ollinger, IV | |
| 7,730,651 | B2 | 6/2010 | Carpenter | |
| 7,762,015 | B2 | 7/2010 | Smith | |
| 7,832,129 | B2 * | 11/2010 | Briscoe | E02F 9/2883 37/456 |
| 7,882,649 | B2 | 2/2011 | Carpenter | |
| 8,024,874 | B2 | 9/2011 | McClanahan | |
| 8,074,383 | B2 | 12/2011 | McClanahan | |
| 8,104,200 | B2 | 1/2012 | Briscoe | |
| 8,117,772 | B2 | 2/2012 | Harder | |
| 8,122,621 | B2 | 2/2012 | Carpenter | |
| 8,122,622 | B2 | 2/2012 | Smith | |
| 8,122,623 | B1 * | 2/2012 | Hughes | E02F 9/2825 37/457 |
| 8,127,475 | B2 | 3/2012 | Harder | |
| 8,127,476 | B2 | 3/2012 | Bierwith | |
| 8,356,432 | B2 | 1/2013 | Carpenter | |
| 8,393,097 | B2 | 3/2013 | Harder | |
| 8,397,405 | B2 | 3/2013 | Harder | |
| 8,689,472 | B2 | 4/2014 | Carpenter | |
| 8,839,535 | B2 | 9/2014 | Carpenter | |
| 8,978,277 | B2 * | 3/2015 | Knight | E02F 9/2891 37/456 |
| 9,157,217 | B2 | 10/2015 | Vannitamby | |
| 9,222,243 | B2 * | 12/2015 | Cheyne | E02F 9/2883 |
| 9,222,353 | B2 | 12/2015 | Morris | |
| 9,493,930 | B2 | 11/2016 | Carpenter | |
| 9,650,764 | B2 | 5/2017 | Carpenter | |
| 9,816,254 | B2 | 11/2017 | Carpenter | |
| 9,963,853 | B2 | 5/2018 | Ollinger, IV | |
| 10,030,367 | B2 | 7/2018 | Dare | |
| 10,273,662 | B2 | 4/2019 | Carpenter | |
| 10,364,553 | B2 | 7/2019 | Snyder | |
| 10,364,554 | B2 | 7/2019 | Cheyne | |
| 10,724,559 | B2 | 7/2020 | Heaphy | |
| 10,774,499 | B2 | 9/2020 | Ollinger, IV | |
| 10,829,912 | B2 | 11/2020 | Carpenter | |
| 11,072,913 | B2 | 7/2021 | Cheyne | |
| 11,142,893 | B2 | 10/2021 | Dare | |
| 11,359,355 | B2 | 6/2022 | Cheyne | |
| 11,441,296 | B2 * | 9/2022 | Bingham | E02F 9/2833 |
| 2002/0000053 | A1 | 1/2002 | Adamic et al. | |
| 2014/0352180 | A1 * | 12/2014 | Campomanes | F16B 7/042 37/455 |
| 2017/0328037 | A1 * | 11/2017 | Serrurier | E02F 9/2841 |
| 2019/0153703 | A1 | 5/2019 | Hyde | |
| 2019/0330826 | A1 | 10/2019 | Snyder | |
| 2020/0370271 | A1 | 11/2020 | Ollinger, IV | |
| 2021/0156123 | A1 | 5/2021 | Gururaj | |
| 2021/0246935 | A1 | 8/2021 | Grewell | |
| 2022/0333358 | A1 | 10/2022 | Wood | |

FOREIGN PATENT DOCUMENTS

| | | | |
|---|---|---|---|
| CN | 106795708 | A | 5/2017 |
| CN | 107614805 | A | 1/2018 |
| CN | 108699818 | A | 10/2018 |

OTHER PUBLICATIONS

Notice of Allowance mailed May 18, 2026 in corresponding Chinese Patent Application No. 202310384475.4, 4 pages.

* cited by examiner

WEAR MEMBER ASSEMBLY WITH COLLARED FASTENING ASSEMBLY

PRIORITY

This application claims the benefit of the filing date of U.S. Provisional Patent Application 63/329,794, filed Apr. 11, 2022, titled "WEAR MEMBER ASSEMBLY WITH COLLARED FASTENING ASSEMBLY," which is incorporated herein by reference in its entirety.

TECHNICAL FIELD

This disclosure is generally directed to an excavating wear member assembly including a fastening assembly that secures components of the excavating wear member assembly. More particularly, this disclosure is directed to an excavating wear member assembly secured by a fastening assembly having an improved locking structure that may increase stability of the connection.

BACKGROUND

Material displacement apparatuses, such as excavating buckets found on construction, mining, and other earth moving equipment, often include replaceable wear components such as earth engaging wear members. These often come into abrasive, wearing contact with the earth or other material being displaced. For example, excavating wear member assemblies typically comprise a relatively massive adapter portion which is suitably anchored to or formed as a part of equipment such as a forward bucket lip. The adapter portion typically includes a reduced cross-section, forwardly projecting nose. A wear member such as a replaceable intermediate adapter or a replaceable tooth point typically includes a cavity that releasably receives the adapter nose. To retain the tooth point or intermediate adapter on the nose, generally aligned transverse openings are formed on both the tooth point, the intermediate adapter, and the nose, and a suitable connector structure is driven into and forcibly retained within the aligned openings to releasably anchor the replaceable wear member on the associated nose.

There are a number of different types of conventional connector structures. One type of connector structure typically must be forcibly driven into the aligned tooth point and adapter nose openings using, for example, a sledgehammer. Subsequently, the inserted connector structure must be forcibly pounded out of the tooth point and adapter nose openings to permit the worn tooth point to be removed from the adapter nose and replaced. This conventional need to pound in and later pound out the connector structure can be challenging and time consuming.

Various alternatives to pound-in connector structures have been previously proposed to releasably retain wear members. While these alternative connector structures desirably eliminate the need to pound a connector structure into and out of an adapter nose, they typically present various other types of problems, limitations, and disadvantages including, but not limited to, complexity of construction and use or undesirably high cost.

Some types of connector structures are rotatable between a locked position and an unlocked position. However, the continuous vibration, high impact, and cyclic loading of the tooth point can result in inadvertent rotation of the connector structure from a locked position to an unlocked position. This may cause excess wear on the connector structure and tooth point interface and may affect the useful life of both the connector structure and the tooth point. Moreover, this can cause loss of the earth engaging wear members, which can damage the bucket and equipment. This can also result in more downtime, lowering productivity.

A need accordingly exists for an improved connector structure.

SUMMARY

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following. One or more features of any embodiment or aspect may be combinable with one or more features of other embodiment or aspect.

Some embodiments of the present disclosure include a fastening assembly for securing a wear member. The fastening assembly may include a collar and a pin. The collar may have an exterior surface and may include an aperture, a collar lock projecting from the exterior surface of the collar, and a pin lock disposed on a portion of the aperture. The collar lock may be elastically deformable while introducing the collar to a wear member and to engage with a collar lock engagement hole in an opening of the wear member. The pin may be shaped to be inserted into the aperture of the collar, and may have a pin lock engagement hole shaped to engage with the pin lock.

In some embodiments, the collar may comprise a projection forming a part of the exterior surface. The projection may have a surface angled relative to a longitudinal axis that is at a different angle than an opposing portion of the exterior surface. In some embodiments, the collar may comprise a first collar lock located on a first side of the projection and a second collar lock located on a second side of the projection. In some embodiments, a height of the collar at the projection may be greater than a height of the opposing portion of the exterior surface. In some embodiments, the pin lock may be aligned with the projection. In some embodiments, the outer surface may comprise a flat region. In some embodiments, the collar lock may be disposed on the flat region. In some embodiments, the collar lock may comprise a compressible base and a head. In some embodiments, the aperture of the collar may be biased towards a leading end of the wear member.

Some embodiments of the present disclosure include a fastening assembly for securing a wear member. The fastening system may include a collar configured to be secured in the wear member and a threaded pin. The collar may have a cavity-facing end, an outwardly facing end, and an outer surface extending between the cavity-facing end and the outwardly facing end. The collar may taper from the cavity-facing end to the outwardly facing end. The collar may have an aperture defining a longitudinal axis, a collar lock disposed at the outer surface, and a pin lock disposed in the collar and projecting into the aperture. The collar lock may be compressible. The pin lock may comprise a compressible body and a plunger that projects into the aperture. The pin may be shaped to fit into the aperture and may have a pin lock engagement hole for engaging with the pin lock.

In some embodiments, the collar may comprise a projection forming a part of the outer surface. The projection may have a surface angled relative to the longitudinal axis at a different angle than an opposing portion of the outer surface.

In some embodiments, the collar may comprise a first collar lock located on a first side of the projection and a second collar lock may be located on a second side of the projection. In some embodiments, a height of the projection may be greater than a height of the opposing portion of the outer surface. In some embodiments, the pin lock may be aligned with the projection. In some embodiments, the outer surface may comprise a flat region. In some embodiments, the collar lock may be disposed on the flat region. In some embodiments, the aperture of the collar may be biased towards a leading end of the wear member. In some embodiments, the collar may be asymmetrical about a longitudinal axis.

Some embodiments of the present disclosure include a wear member assembly comprising a wear member and a fastening assembly. The wear member may have a leading end, a trailing end, and a cavity formed in the trailing end, a side opening in communication with the cavity. The side opening may have a collar lock engagement hole therein. The fastening assembly may include a collar shaped to fit into the side opening of the wear member and a pin. The collar may have a collar lock projecting from an exterior surface of the collar. The collar lock may be elastically deformable while introducing the collar into the side opening of the wear member and configured to engage with the collar lock engagement hole. The pin may be shaped to fit through the collar in the side opening of the wear member.

In some embodiments, the collar may have a thickness smaller than a thickness of the side opening. In some embodiments, the side opening may comprise a protrusion recess extending toward the leading end of the wear member. In some embodiments, a first collar lock engagement hole may be located on a first side of the protrusion recess and a second collar lock engagement hole may be located on a second side of the protrusion recess. In some embodiments, the collar may also comprise a projection forming a part of the exterior surface. The projection may have a surface angled relative to a longitudinal axis at a different angle than an opposing portion of the exterior surface. In some embodiments, the projection may be disposed within the protrusion recess. In some embodiments, the protrusion recess may prevent the collar from passing through the side opening to an exterior of the wear member. In some embodiments, the collar may also comprise a pin lock disposed on the collar and the pin lock may engage a pin lock engagement hole on the pin.

Some embodiments of the present disclosure may include a wear member assembly comprising a wear member and a fastening assembly. The wear member may have a cavity on a trailing end and a opening on a first side. The opening may have a collar lock engagement hole. The fastening assembly may have a collar and a pin. The collar may be disposed within the opening. The collar may include a collar lock at an outer surface of the collar engaged with the opening to lock the collar in the opening, an aperture, and a pin lock disposed in the collar and projecting into the aperture. The pin may be disposed within the aperture of the collar. The pin may have a pin lock engagement hole engaged with the pin lock and locking the pin in the aperture.

In some embodiments, the collar may have a thickness smaller than a thickness of the side opening. In some embodiments, the side opening may comprise a protrusion recess extending toward a leading end of the wear member. In some embodiments, a first collar lock engagement hole may be located on a first side of the protrusion recess and a second collar lock engagement hole may be located on a second side of the protrusion recess. In some embodiments, the collar may also comprise a projection forming a part of the outer surface. The projection may have a surface angled relative to a longitudinal axis at a different angle than an opposing portion of the outer surface. In some embodiments, the projection may be disposed within the protrusion recess. In some embodiments, the pin lock may be aligned with the projection. In some embodiments, the protrusion recess may prevent the collar from passing through the side opening to an exterior of the wear member.

Some embodiments of the present disclosure include methods of securing a fastening assembly to a wear member. The method may include providing a wear member having a leading end, a trailing end, and a cavity formed in the trailing end, a side opening in communication with the cavity, the side opening having a collar lock engagement hole therein. The method may also include inserting a collar shaped to fit into the side opening of the wear member. The collar may include an aperture, a collar lock, and a pin lock. The collar lock may project from an exterior surface of the collar. The collar lock may be compressible and configured to elastically deform while introducing the collar into the side opening of the wear member. The collar lock may be configured to engage with the collar lock engagement hole. The pin lock may be disposed in the collar and may project into the aperture. The pin lock may have a compressible body and a plunger that projects into the aperture. The collar lock may compress when the collar is being inserted and decompressed when the collar lock engages with the collar lock engagement hole. The method may also include inserting a pin into the aperture of the collar. The pin may have a pin lock engagement hole and the pin lock engagement hole may engage with the pin lock as the pin is inserted.

In some embodiments, the side opening may have a protrusion recess extending toward the leading end of the wear member. In some embodiments, a portion of an outwardly facing end of the collar contacts the protrusion recess as the collar is inserted, preventing the collar from moving further. In some embodiments, the collar may also comprise a projection forming a part of the exterior surface. The projection may have a surface angled relative to a longitudinal axis that is at a different angle than an opposing portion of the exterior surface. The projection may be configured to fit into the protrusion recess.

Some embodiments of the present disclosure may include the method of securing a fastening assembly to a wear member. The method may include inserting a collar into an opening of a wear member. The collar may comprise an aperture, a collar lock, and a pin lock. The collar lock may project from an exterior surface of the collar. The collar lock may be compressible and configured to engage with a collar lock engagement hole in an opening of the wear member. The pin lock may be disposed on a portion of the aperture. The collar lock may lock the collar to the opening when the collar lock passes over a collar lock engagement hole in the opening. The method may also include inserting a pin into the aperture of the collar. The pin lock may lock the pin to the collar when a pin lock engagement hole on the pin passes over the pin lock.

In some embodiments, the collar may also comprise a projection forming a part of the exterior surface. The projection may have a surface angled relative to a longitudinal axis that is at a different angle than an opposing portion of the exterior surface. In some embodiments, a first collar lock is located on a first side of the projection and a second collar lock is located on a second side of the projection. In some embodiments, the projection points towards a leading end of the wear member when it is inserted.

It is to be understood that both the foregoing general description and the following drawings and detailed description are exemplary and explanatory in nature and are intended to provide an understanding of the present disclosure without limiting the scope of the present disclosure. In that regard, additional aspects, features, and advantages of the present disclosure will be apparent to one skilled in the art from the following detailed description and the drawings.

BRIEF DESCRIPTION OF THE DRAWINGS

The accompanying drawings illustrate implementations of the assemblies, devices, and methods disclosed herein and together with the description, serve to explain the principles of the present disclosure.

Figure 1:
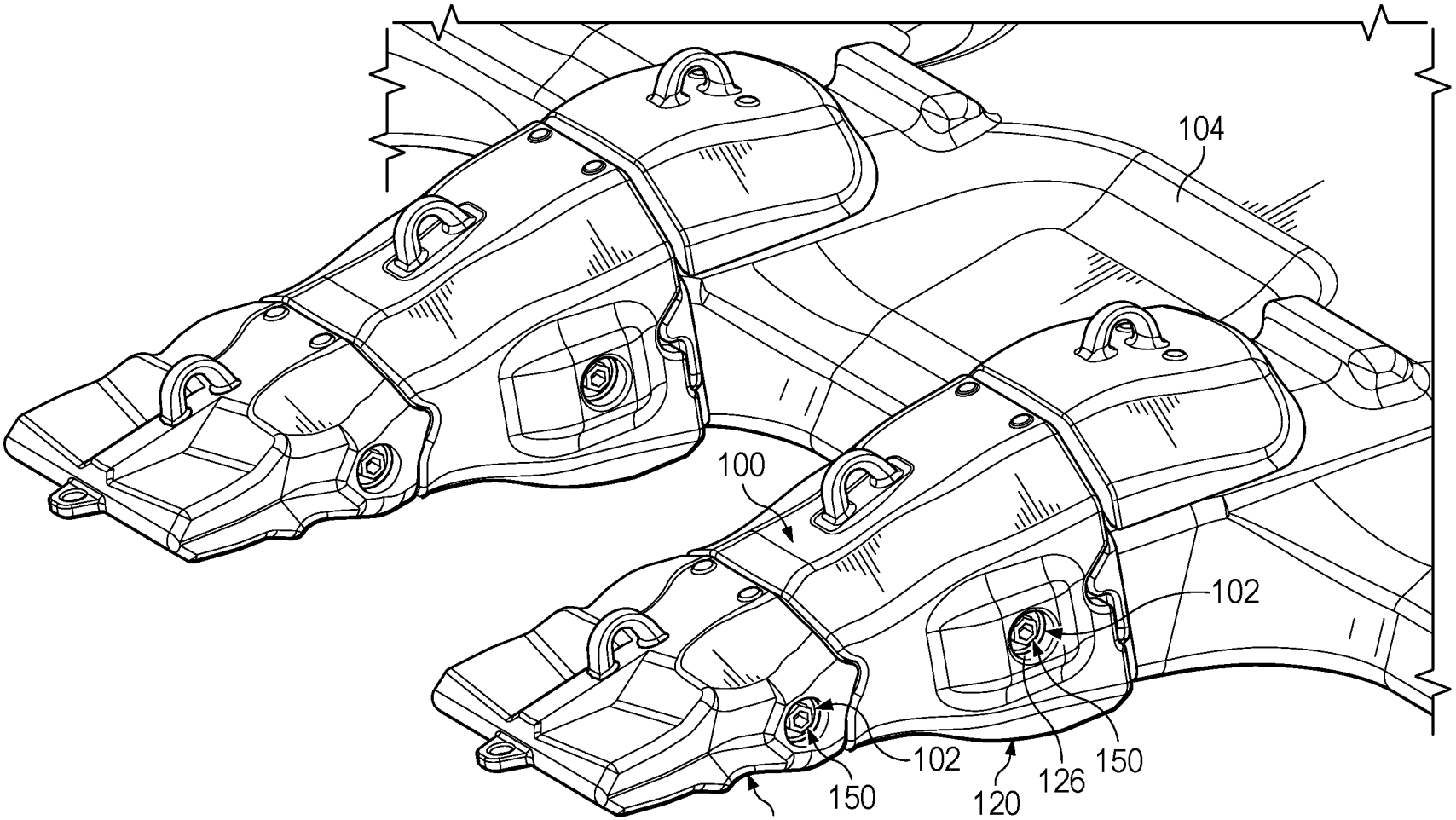
FIG. 1 is a perspective view of an earth engaging wear member assembly according to an example incorporating principles described herein.

These Figures will be better understood by reference to the following Detailed Description.

DETAILED DESCRIPTION

For the purposes of promoting an understanding of the principles of the present disclosure, reference will now be made to the implementations illustrated in the drawings and specific language will be used to describe them. It will nevertheless be understood that no limitation of the scope of the disclosure is intended. Any alterations and further modifications to the described devices, instruments, methods, and any further application of the principles of the present disclosure are fully contemplated as would normally occur to one skilled in the art to which the disclosure relates. In addition, this disclosure describes some elements or features in detail with respect to one or more implementations or Figures, when those same elements or features appear in subsequent Figures, without such a high level of detail. It is fully contemplated that the features, components, and/or steps described with respect to one or more implementations or Figures may be combined with the features, components, and/or steps described with respect to other implementations or Figures of the present disclosure. For simplicity, in some instances the same or similar reference numbers are used throughout the drawings to refer to the same or like parts.

The present disclosure is directed to a ground-engaging wear assembly including a fastening assembly that is arranged to removably secure a wear member to another wear member or a structure of the equipment. In some examples, the fastening assembly may secure a wear member, such as a tooth, adapter including a main adapter and/or an intermediate adapter, shroud, lip, or other wear member to another wear member or base structure or lip. In an example, the fastening assembly may secure an excavating tooth to an adapter, whether the adapter is an intermediate adapter or to an adapter secured to or an integral part of a lip. In other examples, the fastening assembly may secure an excavating tooth directly to a nose on a lip. The tooth, as an exemplary wear member, has a cavity that will fit over the leading end of the adapter and openings on either side that are shaped to fit the fastening assembly. The fastening assembly may include a collar which can be inserted into an opening of the tooth from the cavity. The collar may contain one or more collar locks on the exterior that compress when the collar is inserted into the opening and decompress when they pass over a collar lock engagement hole located on the wall of the opening. This secures the collar to the opening of the tooth. Once the collar is inserted, the tooth is placed over the adapter. The adapter may have openings on either side that align with the openings on the tooth when the tooth is placed over the adapter. To secure the tooth to the adapter, a pin can be inserted into the opening of the tooth and pass through the opening on the adapter. The collar may have a pin lock which compresses as the pin is inserted and decompresses when it passes over a pin lock engagement hole on the pin. This secures the pin to the collar and locks the tooth to the adapter. The fastening assembly may be used to secure other components in a ground-engaging assembly, including, for example, securing an adapter to a nose on a lip, a shroud to a lip, or a wear runner to a lip.

Figure 2:
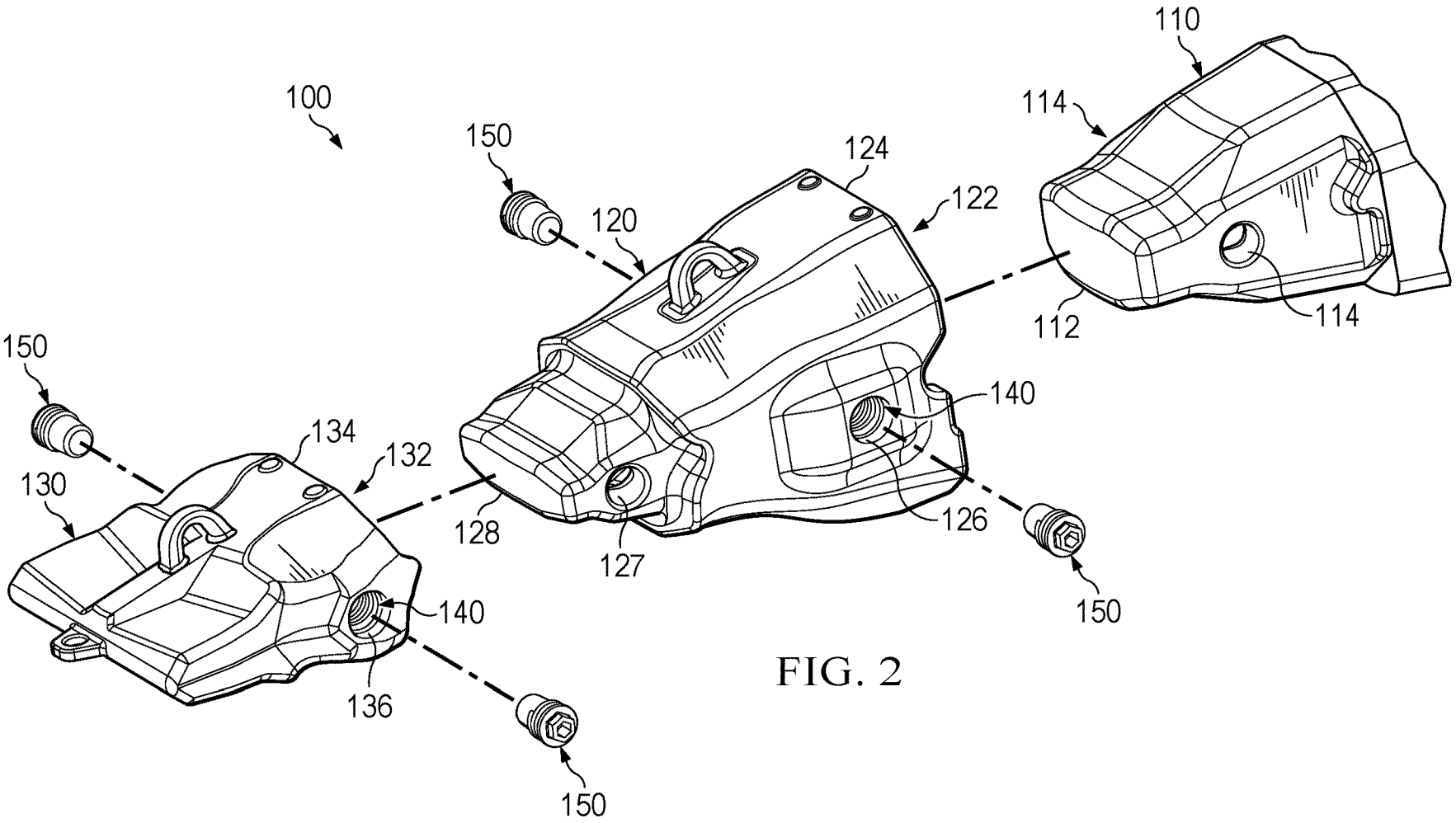
FIG. 2 is an exploded view of an earth engaging wear member assembly according to an example incorporating principles described herein.

FIG. 1 illustrates a ground engaging assembly 100 using a collar and pin fastening assembly 102 according to one embodiment of the present invention. FIG. 2 shows an exploded view of the ground engaging member 100 shown in FIG. 1. The ground engaging member 100 comprises a nose 110 (visible only in FIG. 2) which may be formed on the lip of a support structure 104 (visible only in FIG. 1, e.g., a bucket). The ground engaging member 100 may also include an adapter 120, which may be an intermediate adapter, that can be attached to the nose 110. Moreover, the ground engaging member 100 may also include a tooth 130 that can be attached to the adapter 120.

The adapter 120 can be secured to the nose 110 via the fastening assembly 102. In the example described herein, the fastening assembly 102 may include a collar 140 and pin 150, as described in more detail below. The adapter 120 has a cavity 122 (not visible in FIGS. 1 and 2, but described later herein) on its trailing end 124. The cavity 122 of the adapter 120 can fit over the leading end 112 of the nose 110. The nose may have openings 114 which are shaped to receive the fastening assembly 102. In this embodiment, the nose 110 has two openings 114, one opening 114 on each side of the nose 110. In other examples, the nose 110 may have only one opening 114 on one side. In some embodiments, the openings 114 may be on another part of the nose 110, including, for example, on the top. The openings 114 may connect to form a through passage through the nose 110 or may be blind bores. The adapter 120 also has openings 126, 127 that are shaped to cooperate with the fastening assembly 102. In this embodiment, the adapter 120 has four openings 126, 127, two back openings 126 and two front openings 127. The back openings 126 are located proximate to the trailing end 124 of the adapter 120, one opening 126 on each side of the adapter 120. The front openings 127 are located proximate to the leading end 128 of the adapter 120, one opening 127 on each side of the adapter 120. In other embodiments, the nose 110 may have one opening 114 or may have more than two openings 114. In other embodiments, adapter 120 may have any number of openings 126, 127, including, for example, one back opening 126 and one front opening 127. In some embodiments, the openings 126, 127 may be on another part of the adapter 120, including, for example, on the top.

Before the adapter 120 is placed over the nose 110, a collar 140 (also visible in cross-section in FIG. 3) may be inserted into each back opening 126 of the adapter 120. In some embodiments, the back openings 126 pass from the exterior of the adapter 120 through to the cavity 122 of the adapter 120. Therefore, the collar 140 may be inserted into the back openings 126 from the cavity 122. The structure and purpose of the collars 140 are described in further detail below with reference to FIGS. 7-10. Once the collar 140 is inserted into the back openings 126 of the adapter 120, the adapter 120 may be placed over the nose 110 such that the back openings 126 of the adapter 120 align with the openings 114 of the nose 110. A pin 150 can then be inserted through the collar 140 in one of the back openings 126 of the adapter 120 and through the corresponding opening 114 of the nose 110. Thus, the pin 150 extends through both the adapter 120 and the nose 110. By inserting the pin 150 through openings 126 and 114, the pin 150 secures the adapter 120 to the nose 110.

Similarly, the tooth 130 can also be secured to the adapter 120 via a separate fastening assembly 102, that may be identical to the one described above. The fastening assembly 102 includes a collar 140 and pin 150. The tooth 130 has a cavity 132 (not visible in FIGS. 1 and 2, but described later herein) on its trailing end 134. The cavity 132 of the tooth 130 can fit over the leading end 128 of the adapter 120. The tooth 130 may also have openings 136 that are shaped to fit the fastening assembly. In this embodiment, the tooth 130 has two openings 136, one opening 136 on each side of the nose 130. However, in other embodiments, the tooth 130 may only have one opening 136 or may have more than two openings 136. In some embodiments, the openings 136 may be on another part of the tooth 130, including, for example, on the top.

In the same manner described above with the adapter 120, before the tooth 130 is placed over the adapter 120, the collar 140 may be inserted into the opening 136 of the tooth 130. In some embodiments, the openings 136 pass from the exterior of the tooth 130 through to the cavity 132 of the tooth 130. Therefore, the collar 140 may be inserted into the openings 136 from the cavity 132. Once the collar 140 is inserted into openings 136 of the tooth 130, the tooth 130 may be placed over the leading end 128 of the adapter 120 such that the openings 136 of the tooth 130 align with the front openings 127 of the adapter 120. A pin 150 can then be inserted through the collar 140 in one of the openings 136 of the tooth 130 and through the corresponding front opening 127 of the adapter 120. Thus, the pin 150 extends through both the tooth 130 and the adapter 120. By inserting the pin 150 through openings 136 and 127, the pin 150 secures the tooth 130 to the adapter 120.

In this embodiment, the openings are located on the sides of the nose 110, adapter 120, and tooth 130. However, the openings can be located anywhere on the nose 110, adapter 120, or tooth 130, including, for example, on the bottom or top surfaces.

The fastening assembly 102 generally operates in the same way for securing an adapter to a nose, securing a tooth to an adapter or an adapter nose, or securing any wear member to another wear member or a structure on a piece of equipment. Therefore, although embodiments of securing a tooth to an adapter are described below, the present disclosure is not so limited and may include securing any two members together.

Figure 3:
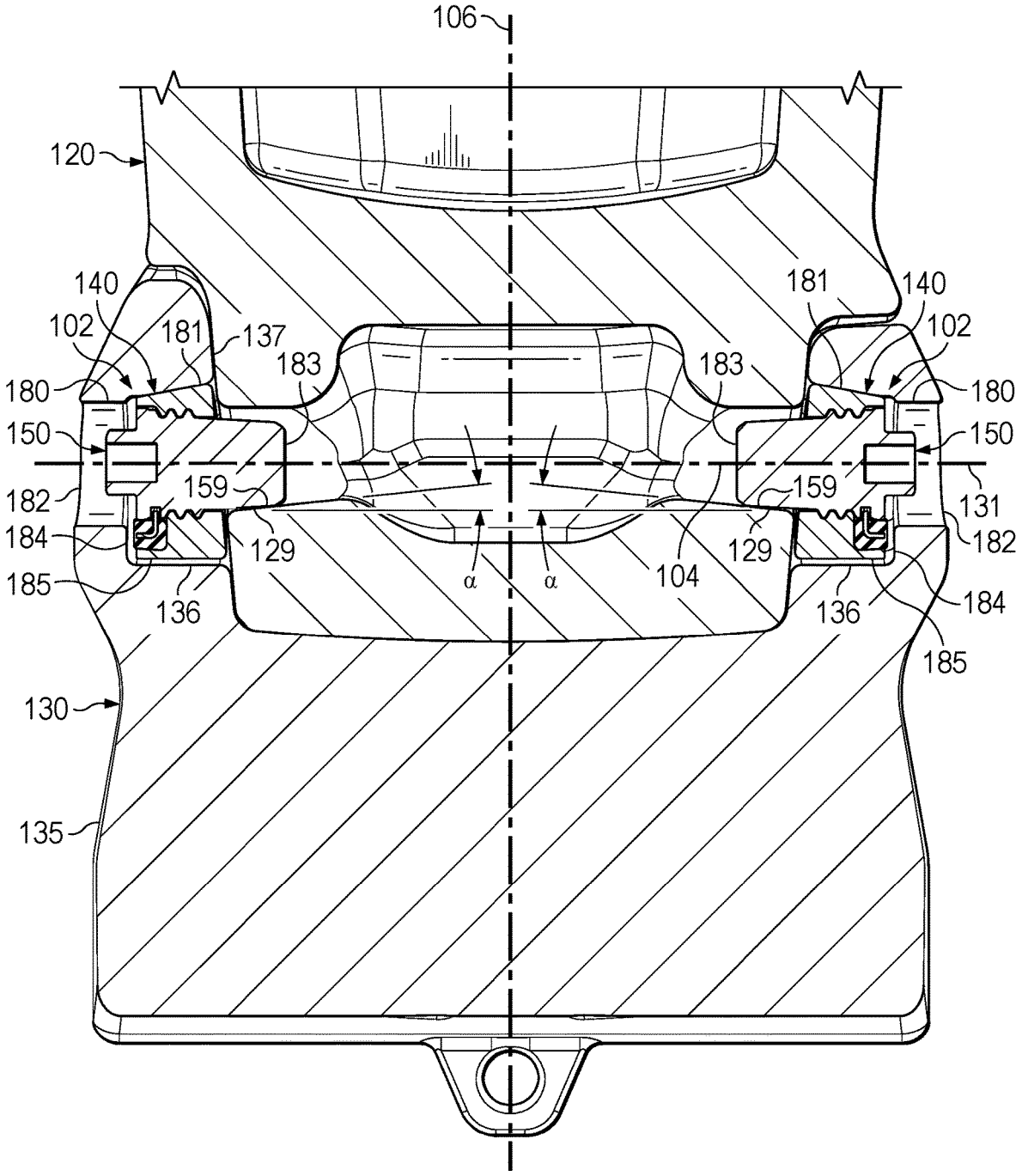
FIG. 3 is a cross-sectional view of a tooth and adapter assembly according to an example incorporating principles described herein.

FIG. 3 shows a horizontal cross-sectional view of an assembled tooth 130 and adapter 120 secured using the fastening assembly 102 according to one example implementation (where the cross-section is taken through the fastening assemblies 102). In this embodiment, the collars 140 are disposed within openings 136 of the tooth 130. The pins 150 are threaded into the collars 140 such that the pins 150 extends into both the tooth 130 and the adapter 120. FIG. 3 shows a transverse nose axis 131. In some implementations, the nose may be a part of a lip, an adapter, an intermediate adapter, or other wear member component. Here, the transverse nose axis 131 may be coaxial with the longitudinal axis of the pins 150. There is also a longitudinal axis of the tooth 106.

In some implementations, the collar 140 and the openings 136 and 127 are shaped so that the aperture 141 in the collar 140 is biased forward. Because the pin 150 may be tapered from an outwardly facing end 151 to a cavity facing end 157, when the pin 150 is disposed within the collar 140 and the opening 127 of the adapter 120, the opening 136 is biased forward such that a forward surface 159 of the pin 150 contacts the forward surface 129 of the opening 127 along its length. The forward surface 159 of the pin 150 may form an angle $\alpha$ with the forward surface 129 of the opening 127. The angle $\alpha$ can be any appropriate angle, including an angle in the range of 0° to 8°, though larger angles are contemplated. When the aperture 141 is biased forward, the length of the pin 150 presses against a forward surface 129 of the opening 127. This stabilizes the pin 150 and provides more even loading along the pin 150 when the tooth-and-adapter assembly is in use.

The tooth 130 has an outer surface 135 and an inner surface 137. The opening 136 of the tooth 130 has two portions: a narrow portion 180 and a wide portion 181. The narrow portion 180 is disposed at the outwardly facing end 182 of the opening 136. The wide portion 181 is disposed at the cavity facing end 183 of the opening 136. On one side of the opening 136, there may be a shoulder 184 between the narrow portion 180 and the wide portion 181. The shoulder 184 forms a protrusion recess 185 within the wide portion 181. In some implementations, the shoulder 184 and protrusion recess 185 may be disposed along the opening 136 towards the leading end 133 of the tooth 130. In other implementations, there may be a shoulder 184 between the narrow portion 180 and the wide portion 181 that is around the entire circumference of the two portions. In this some of these embodiments, the depth of the shoulder 184 may not be uniform.

Figure 4:
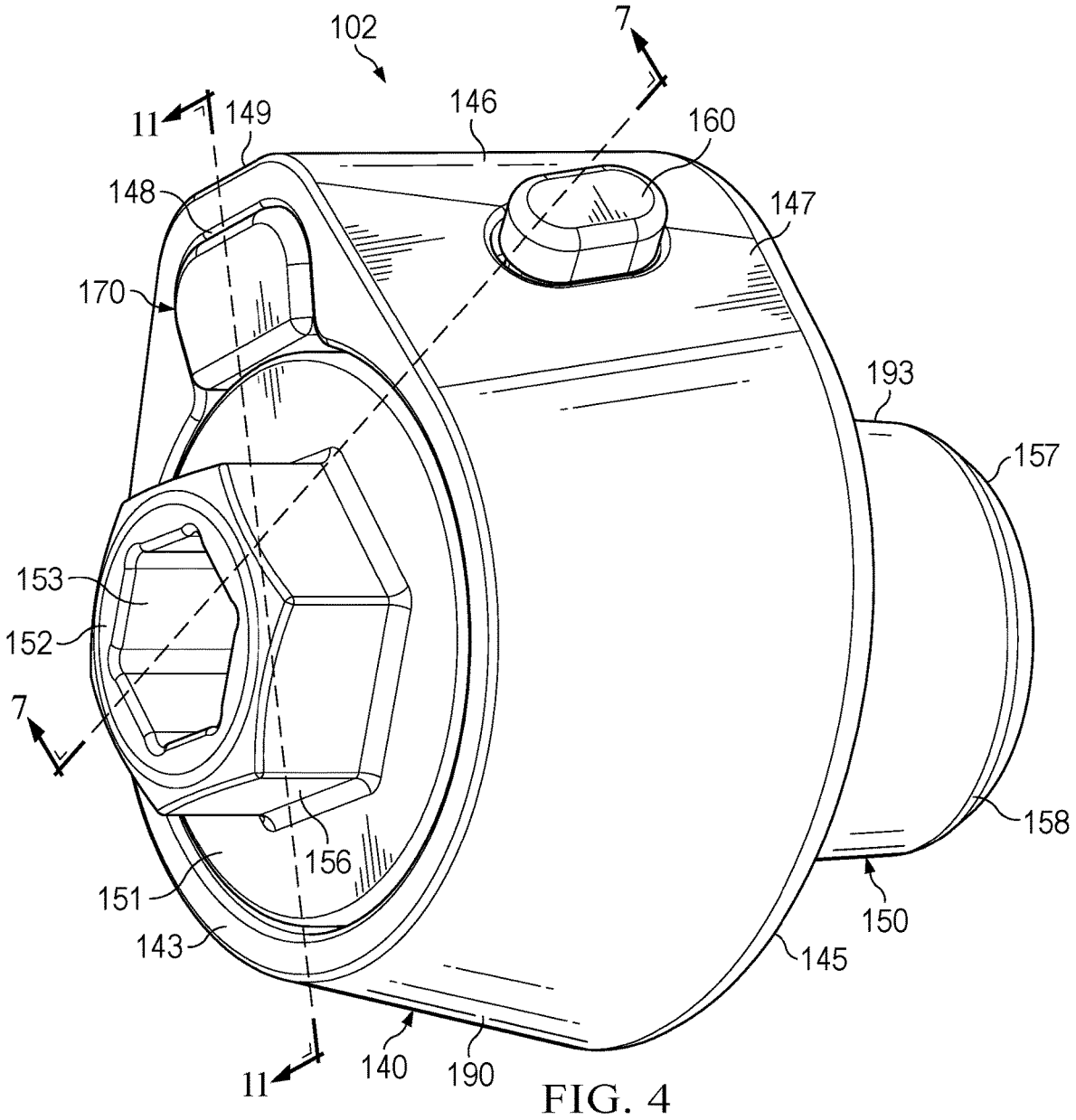
FIG. 4 is a perspective view of a fastening assembly according to an example incorporating principles described herein.
Figure 5:
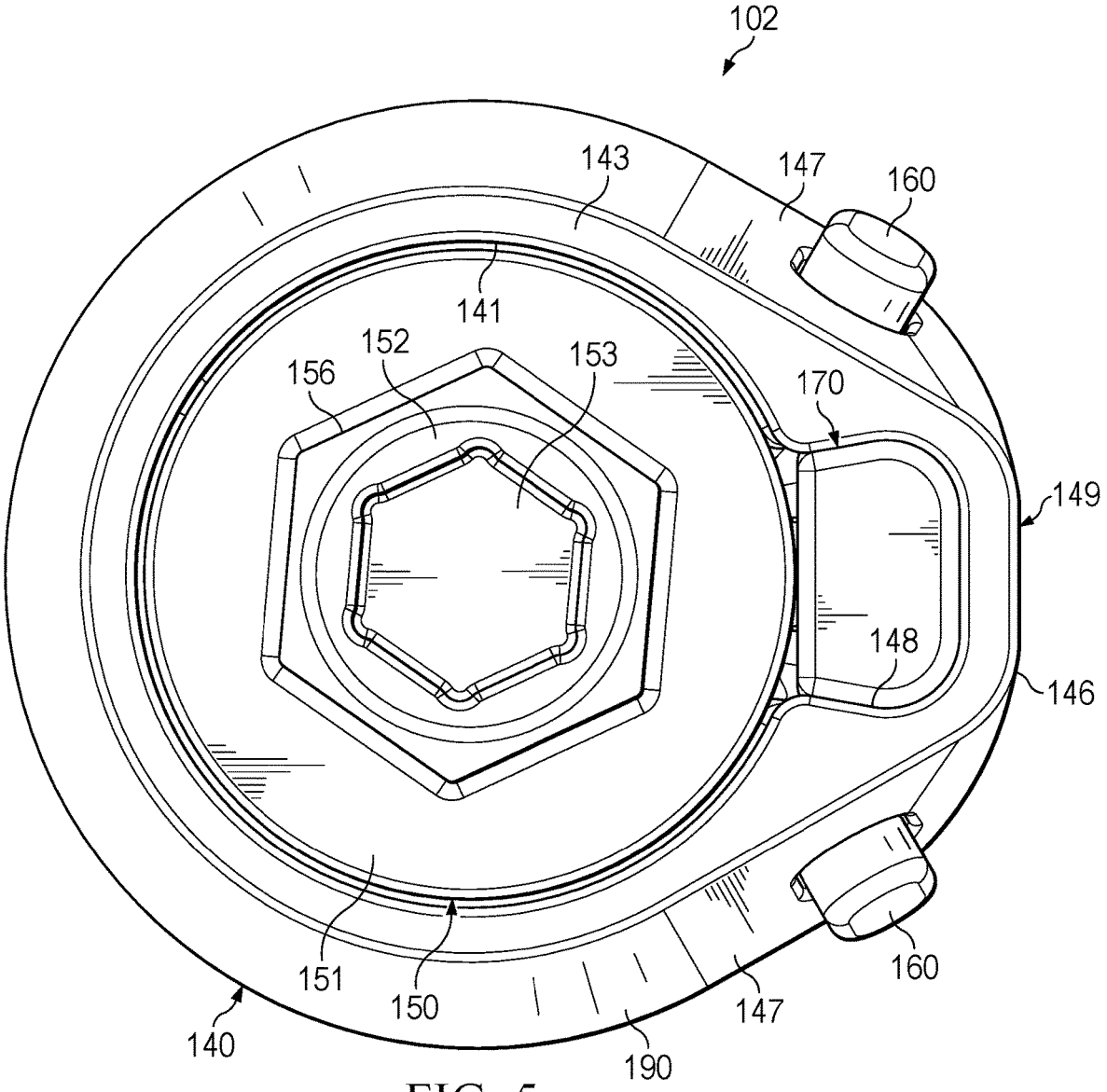
FIG. 5 is a top view of a fastening assembly according to an example incorporating principles described herein.
Figure 6:
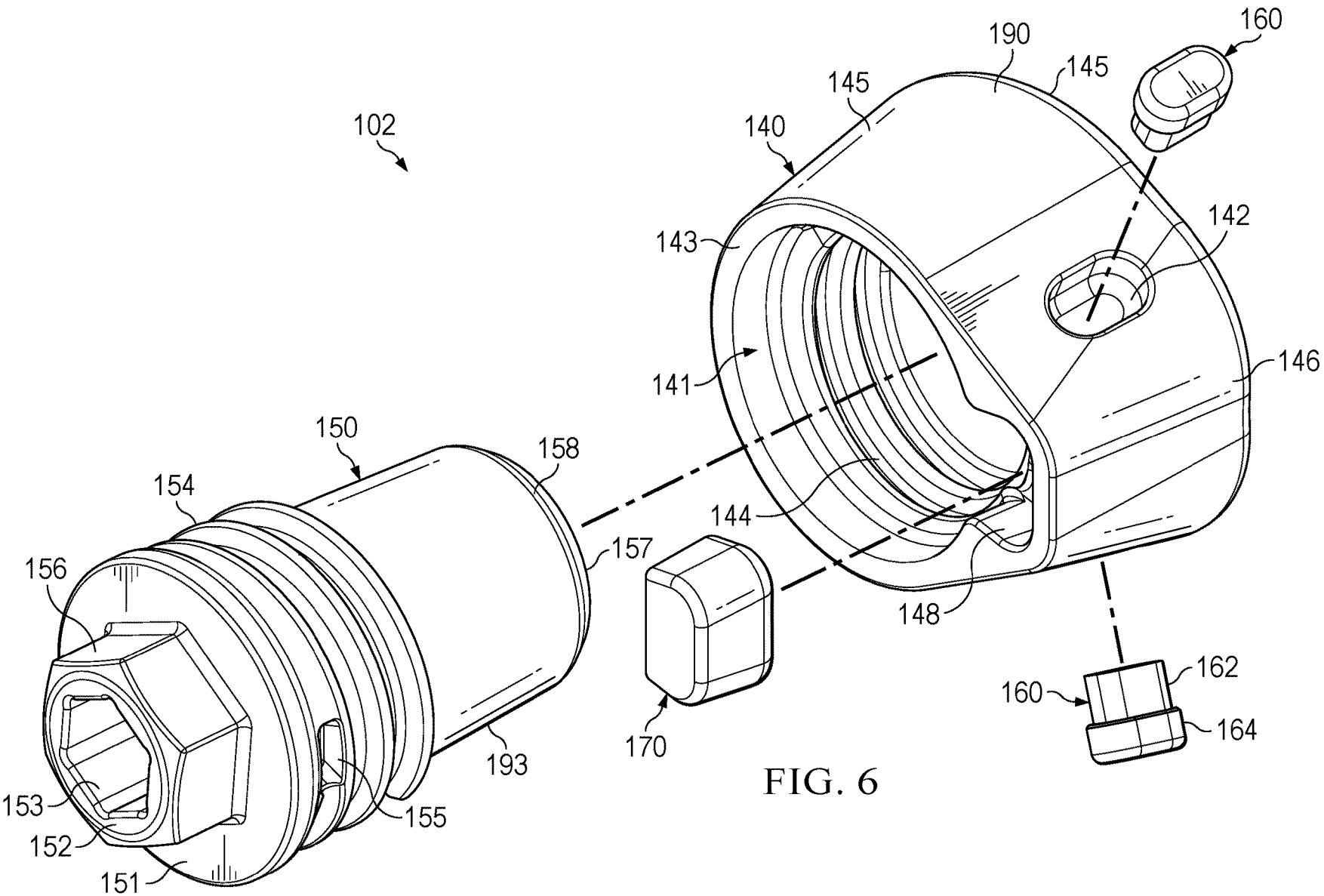
FIG. 6 is an exploded view of a fastening assembly according to an example incorporating principles described herein.

FIG. 4 shows a perspective view of the fastening assembly 102 according to an embodiment of the present disclosure. FIG. 5 shows a top view of the fastening assembly 102 shown in FIG. 4. FIG. 6 shows an exploded view of the fastening assembly 102 shown in FIG. 4. The collar 140 is generally cylindrically shaped with a cylindrical aperture 141 passing from one face of the cylinder to the other. However, in other embodiments, the collar 140 may be shaped like another prism, such as a rectangular prism, a square prism or a hexagonal prism, with a cylindrical aperture 141 or an aperture 141 of any other shape. The collar 140 contains a continuous portion 190 and a projection 146 (or a discontinuous portion). The projection 146 extends past the continuous portion 190 of the cylinder, thereby making the thickness of the projection 146 larger than the thickness of the continuous portion 190. In some embodiments, the projection 146 may have sides 147 are flat and may also have a flat face 149, which connects the two sides 147. In other embodiments, the projection 146 may be of a different size or may be shaped differently. For example, the projection may be smaller or larger than that of the present embodiment or may come to a point or be rounded. Moreover, the sides 147 or the face 149 of the projection 146 may be curved. The projection 146 prevents the collar 140 from rotating when it is disposed in an opening 136 of the tooth 130.

The collar 140 may be tapered from a cavity facing end 145 to an outwardly facing end 143, as described in more detail below in reference to FIG. 11.

The exterior of the collar 140 contains two collar locks 160. However, in other embodiments, there may be one collar lock 160 or more than two collar locks 160. The collar locks 160 locks the collar to an opening in the tooth (or other member). The operation of the collar 140 is described in more detail below in reference to FIGS. 7-10. The collar 140 has two collar lock holding recesses 142 which are shaped to fit the collar locks 160. The collar locks 160 have a head 164 and a compressible base 162. In this embodiment, the compressible base 162 is comprised of rubber. However, the compressible base 162 may be comprised of any compressible material. Moreover, in other embodiments, the compressible base 162 may be a spring or other biasing member. The head 164 of the collar lock 160 may be comprised of the same material as the compressible base 162 or a different material. In some embodiments, the head 164 of the collar lock 160 may be comprised of a less compressible material than the compressible base 162. For example, the head may be comprised of a metal such as steel, or a polymer or other suitable material. The compressible base 162 may be attached to the collar lock recess 142 on the collar 140 by any appropriate means. For example, the compressible base 162 may be attached using an adhesive, a press fit, an ultrasonic weld, or other attachment system. In this embodiment, the head 164 is elliptically shaped. In other embodiments, the head 164 may be any appropriate shape. In this embodiment, the shape of the base 162 is similar to the shape of the head 164, but with a larger height. In other embodiment, the base 162 may be any appropriate shape and may or may not be the same shape as the head 164. In still other embodiments, the collar lock 160 may be one component rather than having a base 162 and a head 164.

In this embodiment, the pin 150 is cylindrically shaped and has threads 154 that extend down from the top of the pin 150 along a portion of the shaft 193. The aperture 141 of the collar 140 may be at least partially threaded 144 such that the threads 154 can engage with the threads of the aperture 141 such that the pin 150 can be screwed into the collar 140 through the aperture 141. Although in this embodiment the threads 154 only extend from the top of the pin 150 down a portion of the shaft 193, in other embodiments the threads 154 may extend all the way down the shaft 193 to the bottom. In still other embodiments, the threads 154 may extend a shorter way down the length of the pin 150.

There may be a tool engagement feature 152 which extends from the top of the pin 150. The tool engagement feature 152 may have a recess 153. In this embodiment, the tool engagement feature 152 is hexagonally-shaped with a hexagonally-shaped recess 153 that matches the shape of the exterior 156. However, in other embodiments the tool engagement feature 152 may be any appropriate shape. In some embodiments, the shape of the recess 153 of the tool engagement feature 152 does not match the shape of the exterior 156 of the tool engagement feature 152. A tool can engage with the tool engagement feature 153 by contacting the exterior 156 or the interior 153. In some cases, the exterior 156 of the tool engagement feature 152 may be worn, so the pin 150 may be removed or inserted using the recess 153. In cases where the tool engagement feature 152 may be too worn down to function properly, the pin 150 may be removed in any appropriate manner, including, for example, by prying it out. Any appropriate tool may be used to engage with the tool engagement feature 152 including a prybar, screwdriver, or other tool.

The pin 150 may have a chamfer 158 along the bottom edge. The chamfer 158 may ease installation by making it easier to insert the pin 150 into the collar 140. Moreover, the chamfer 158 reduces stresses along the body and shaft 193 of the pin 150.

A pin lock 170 may be attached to the collar 140. The pin lock 170 locks the pin 150 to the collar 140 as described in more detail below in reference to FIGS. 11-12. The collar 140 has a pin lock holding recess 148 shaped to fit the pin lock 170. The pin lock holding recess 148 is located on the interior of the collar 140 along the aperture 141. In this embodiment, the pin lock holding recess 148 is located at the top of the aperture 141 and is aligned with the projection 146. In other embodiments, the recess may be located anywhere along the aperture 141. The pin lock 170 has a plunger 172 and a compressible body 174. The compressible body 174 surrounds a portion of the plunger 172, and biases the plunger radially inward in a manner causing the plunger to engage the pin 150 as described herein. A tip 173 of the plunger 172 extends radially inwardly beyond the compressible body 174. In this embodiment, the plunger 172 is L-shaped. However, in other embodiments, the plunger 172 may be any other appropriate shape, including, for example, T-shaped or linear.

The compressible body 174 may be made of any appropriate material. For example, in this embodiment, the compressible body 174 is comprised of rubber or a polymer that may exert an elastic biasing force when under load. In this embodiment, the pin lock 170 is press fit into the pin lock holding recess 148. The bottom of the pin lock 170 is wider and longer than the top of the pin lock 170. The compressible body 174 of the pin lock 170 can be compressed into the pin lock holding recess 148 and the shape of the pin lock 170 will prevent it from falling out. However, the compressible body 174 of the pin lock 170 may be attached to the pin lock holding recess 148 in the collar 140 by any appropriate means. For example, in some embodiments, the pin lock 170 may be attached to the pin lock recess 148 via an adhesive, a tack weld or using other methods. The plunger 172 may be comprised of any appropriate material. For example, the plunger may be comprised of a metal, such as steel, a polymeric material, or yet other material. Plunger 172 may be attached to the compressible body 174 in any appropriate manner, including, for example, by being embedded therein or otherwise attached, such as by an adhesive, tack weld, or otherwise secured thereto. When the pin 150 is screwed into the collar 140, the tip 173 of the plunger 172 can fit into a pin lock engagement hole 155 on the pin 150, as described in more detail below.

Figure 7:
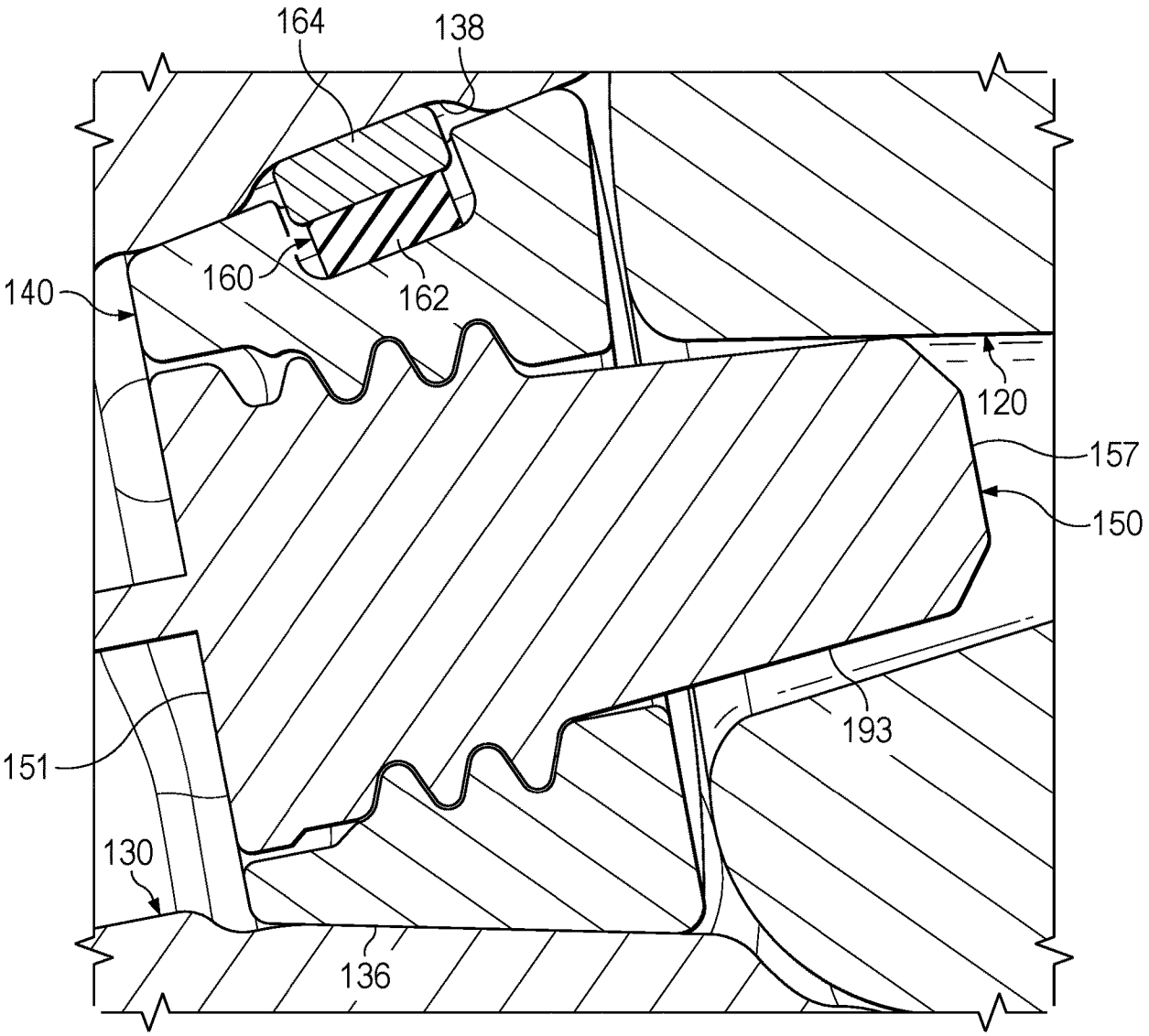
FIG. 7 is a vertical cross-sectional view of a fastening assembly according to an example incorporating principles described herein.
Figure 8:
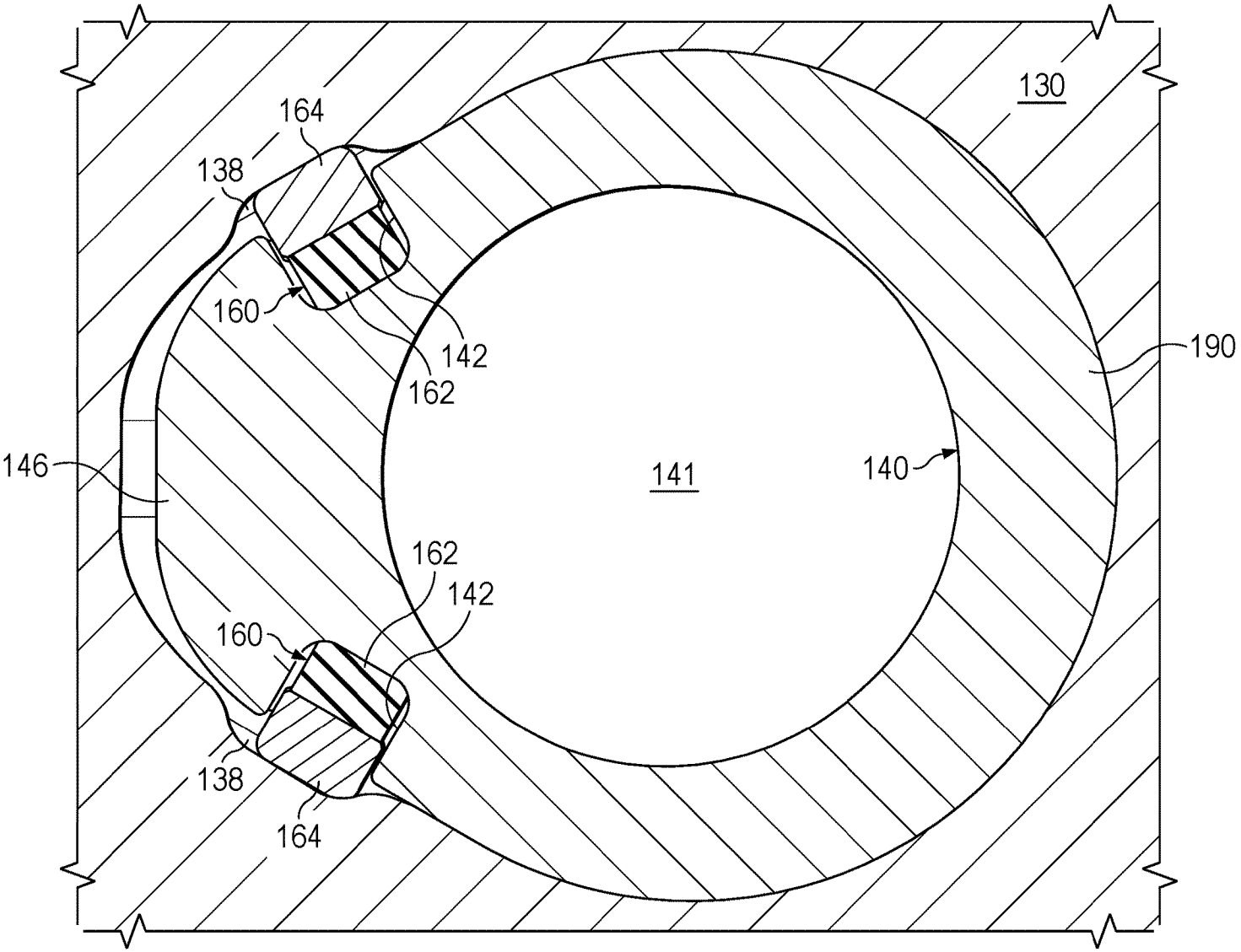
FIG. 8 is a horizontal cross-sectional view of a fastening assembly according to an example incorporating principles described herein.

FIGS. 7 and 8 show cross-sections of the fastening assembly 102 inserted in opening 136 of the tooth 130. FIG. 7 is a vertical cross-sectional view of the fastening assembly 102 inserted in a tooth 130 along the aperture 141 of the collar 140 (as shown in FIG. 4). FIG. 8 is a horizontal cross-sectional view of the fastening assembly 102 inserted in a tooth 130 taken across the collar locks 160. The shape of the opening 136 generally mirrors the shape of the exterior of the collar 140. The opening 136 of the tooth 130 contains two collar lock engagement holes 138. The collar lock engagement holes 138 are shaped to receive the head 164 of the collar lock 160. In this embodiment, the two collar locks 160 are fit into the two collar lock engagement holes 138 in an opening 136 of the tooth 130. The head 162 of the collar lock 160 engages with the collar lock engagement holes 138. In this embodiment, the collar locks 160 are situated on either side of the projection 146 of the collar 140. However, in other embodiments, the collar locks 160 may be disposed at any location along the exterior of the collar 140. For example, the collar locks 160 may be disposed opposite each other (180° apart), the collar locks may be 90° apart, or at any other angle to each other. Moreover, one or more of the collar locks 160 may be located on the projection 146. Although there are two collar locks 160 in this embodiment, in other embodiments there may be any number of collar locks 160 including, for example, one or three collar locks.

Figure 9:
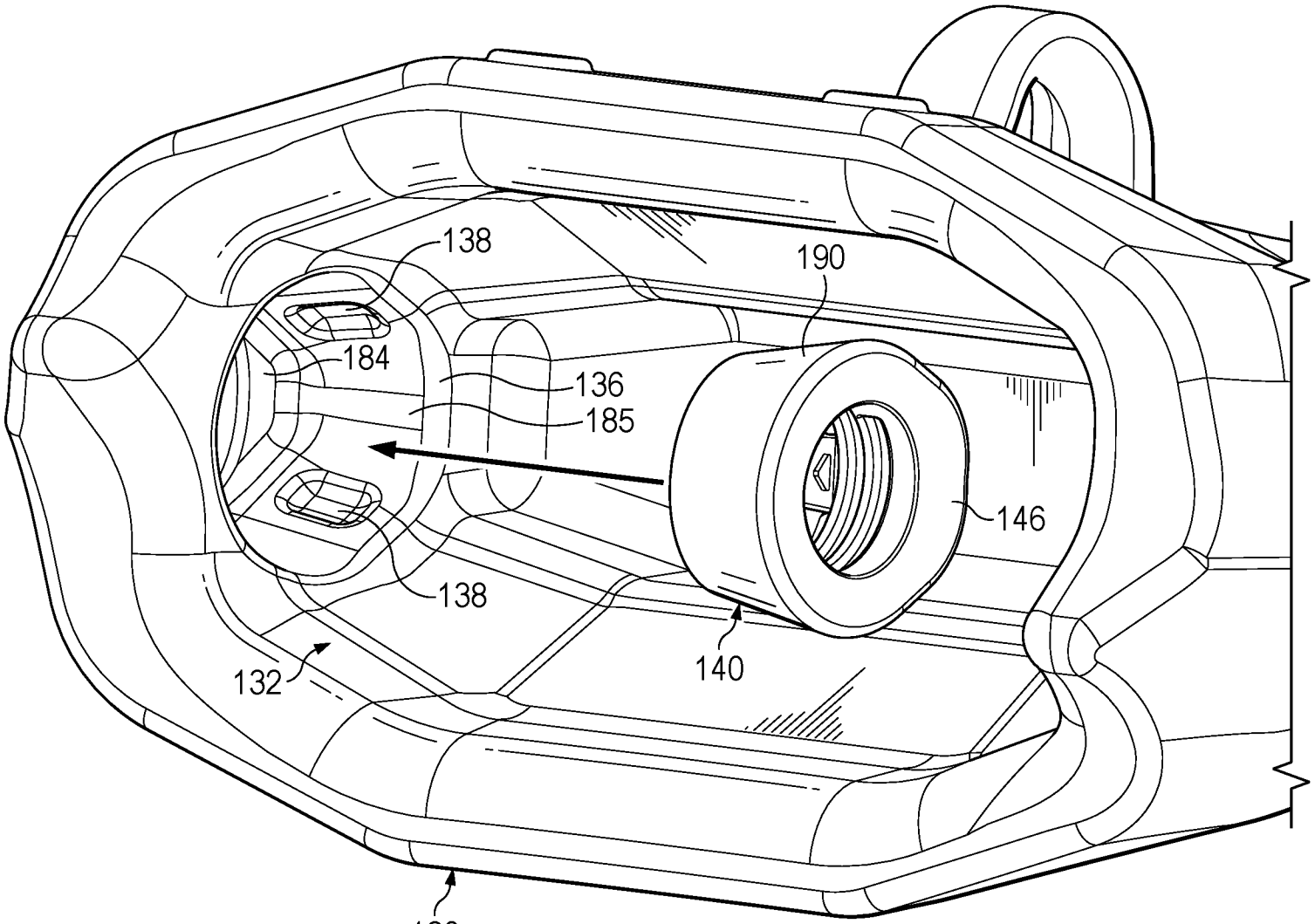
FIG. 9 is a rear view of a tooth and collar before the collar is inserted according to an example incorporating principles described herein.
Figure 10:
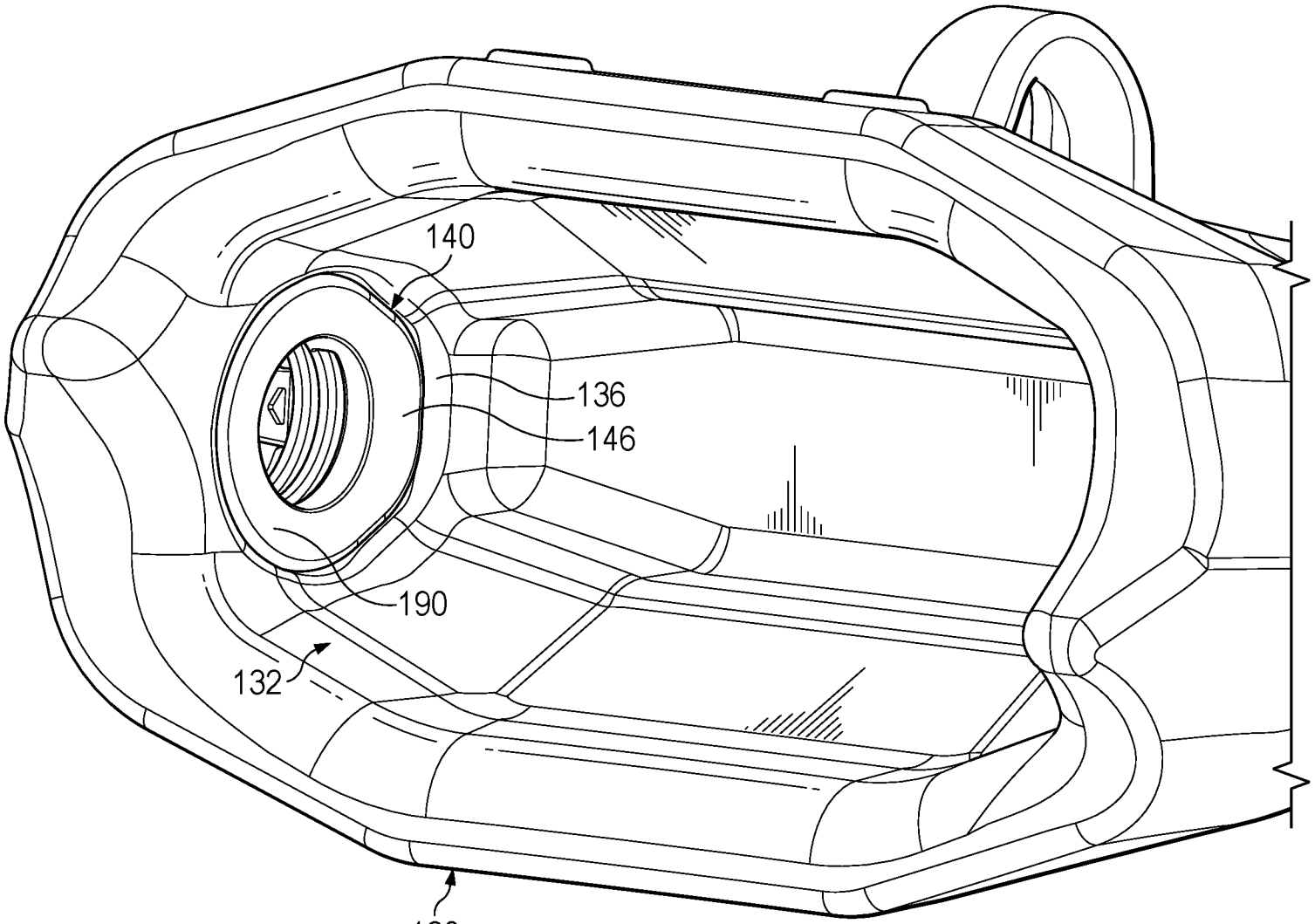
FIG. 10 is a rear view of a tooth and collar after the collar is inserted according to an example incorporating principles described herein.

FIGS. 9 and 10 show a rear view of a collar 140 being inserted into an opening of a tooth 130. FIG. 9 shows the collar before insertion and FIG. 10 shows the collar after insertion. The collar 140 is aligned with the opening 136 such that the projection 146 of the collar 140 aligns with the protrusion recess 145. Then the collar 140 is pressed into the opening 136. As the collar 140 is pressed into the opening 136, the surface of the opening 136 presses against the head 162 of the collar lock 160. This compresses the compressive base 164 of the collar lock 160. When the collar lock 160 moves over the collar lock engagement hole 138, the compressive base 164 decompresses to its original shape. The head 164 of the collar lock 160 is then disposed within the collar lock engagement hole 138, locking the collar 140 to the tooth 130. When the collar 140 is locked, it cannot rotate or move backwards or forwards. Moreover, the tapered shape of the collar 140 and the shoulder 184 prevent the collar from moving forward through the opening 136 to an exterior of the tooth 130. In some embodiments, the collar 140 may be pried out of the opening 136 when replacing the tooth or the fastening assembly 102.

Once the collar 140 is locked in the tooth 130, the tooth 130 may be inserted over the adapter 120. The pins 150 may then be inserted into the collars 140 to secure the tooth 130 to the adapter 120. FIG. 11 shows a vertical cross-sectional view of the fastening assembly 102, where the cross-section is through the pin lock 170 (as shown in FIG. 4). FIG. 12 shows a horizontal cross-sectional view of the fastening assembly 102, where the cross-section is taken through the pin lock 170. The pin lock 170 is disposed within the pin lock holding recess 148 such that the top 171 of the pin lock 170 aligns with the outwardly facing end 143 of the collar 140 and the bottom 175 of the pin lock 170 contacts a floor 176 of the pin lock holding recess 148. The tip 173 of the plunger 172 is disposed within the pin lock engagement hole 155. The tip 173 may come to a point as shown in this particular embodiment. When the tip 173 comes to a point, the tip 173 prevents the pin 150 from rotating further. In other embodiments, the pin 150 may have a different shape, including for example, being rounded or being flat.

As the pin 150 is screwed into the collar 140, the compressible body 174 of the pin lock 170 is compressed. This compression pulls the plunger 172 back, thus allowing the pin 150 to continue moving downward through the collar 140. Once the pin lock engagement hole 155 on the pin 150 aligns with the pin lock 170, the compressible body 174 of the pin lock 170 decompresses. This allows the tip 173 of the plunger 172 to engage with and be disposed within the pin lock engagement hole 155. This prevents the pin 150 from moving downward or upward through the collar 140, thus locking the pin 150 within the collar 140. The pin 150 may be removed by any appropriate tool using the tool engagement feature 152.

When the pin 150 is removed, the tooth 130 can be removed from the adapter 120. In some embodiments the pin 150 can then be reused in further fastening assemblies 102; however, in other embodiments the pin 150 cannot be reused. In some embodiments, the collar 140 is single-use and cannot be reused; however, in other embodiments the collar 140 can be reused in further fastening assemblies. In some embodiments, the pin 150 is reusable and the collar 140 is single use.

Figure 11:
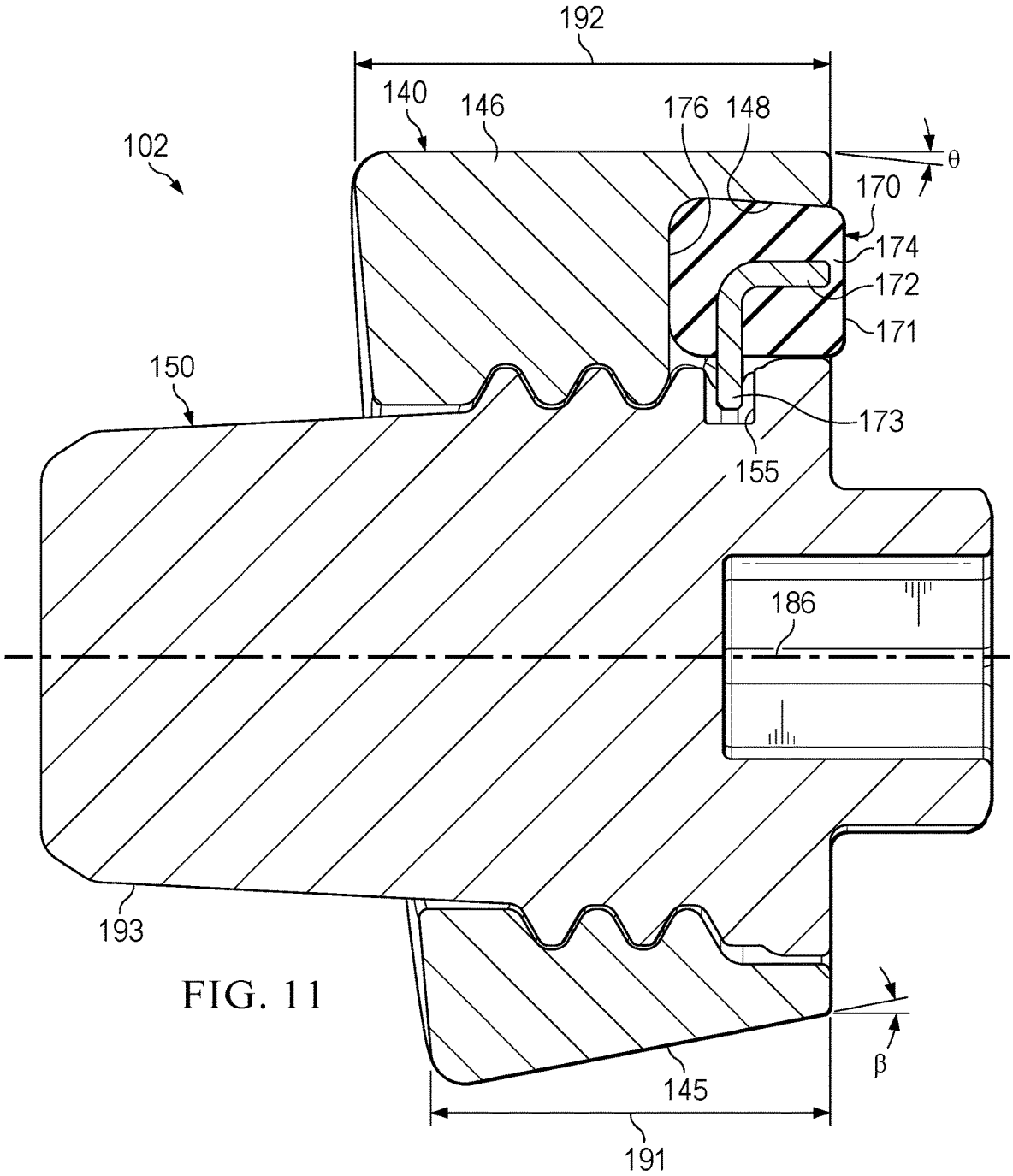
FIG. 11 is a vertical cross-sectional view of a fastening assembly according to an example incorporating principles described herein.
Figure 12:
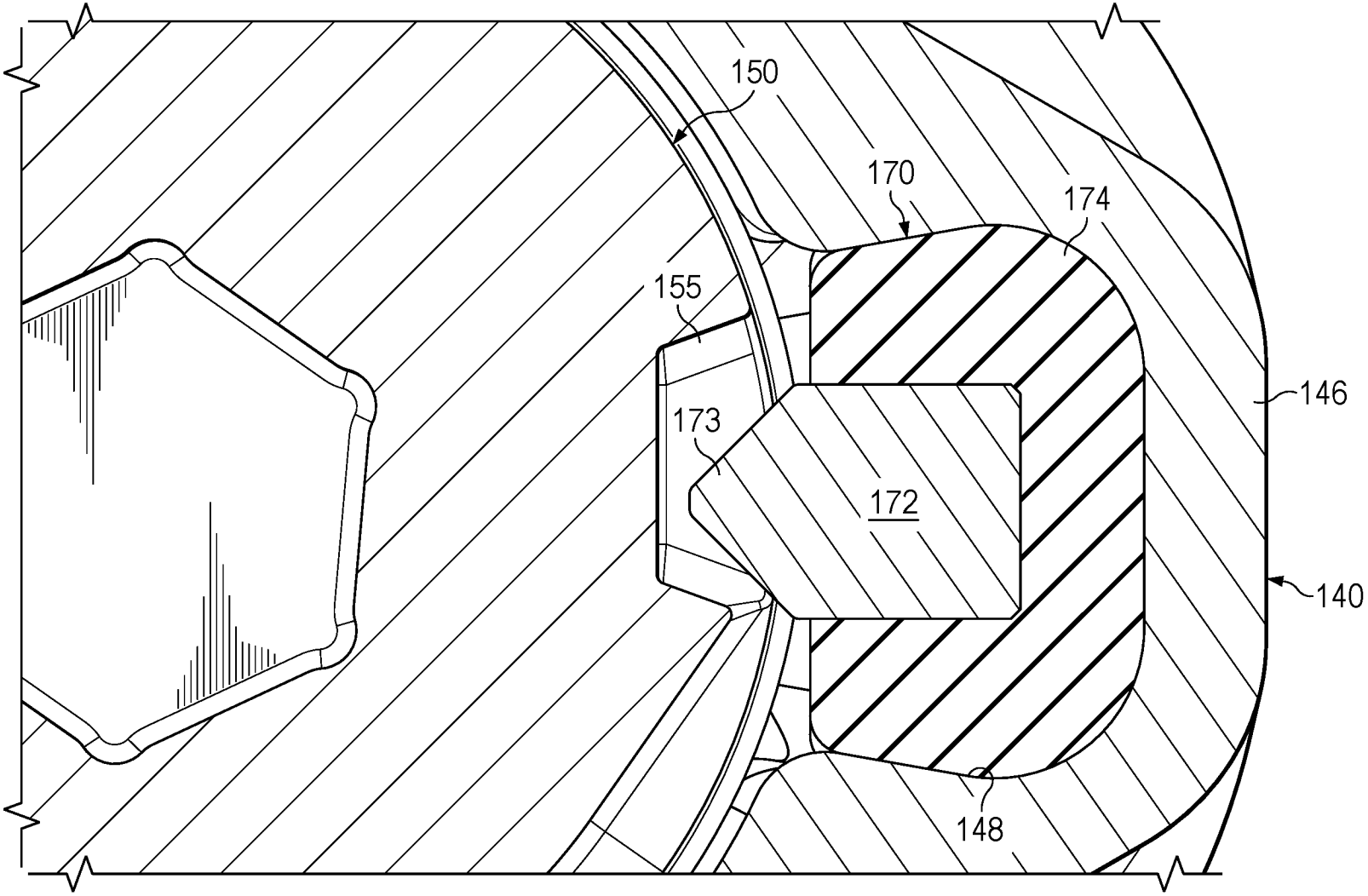
FIG. 12 is a horizontal cross-sectional view of a fastening assembly according to an example incorporating principles described herein.

Moreover, FIG. 11 illustrates how the collar 140 may be tapered according to one embodiment of the present disclosure. There is a longitudinal axis 186 of the pin 150. The continuous portion 190 of the collar 140 is tapered from the bottom to the top, such that the cavity facing end 145 of the collar 140 is wider than the outwardly facing end 143. The angle $\beta$ of tapering of the continuous portion 190 may be any appropriate angle. For example, angle $\beta$ may be in the range of 1° to 20°.

The projection 146 may also be tapered from the cavity facing end 145 of the collar 140 to the outwardly facing end 143. The angle $\theta$ of tapering of the projection 146 may be any appropriate angle. For example, angle $\theta$ may be in the range of 0° to 11°. In some embodiments, the angle $\theta$ of tapering of the continuous portion 190 is not the same as the angle $\theta$ of tapering of the projection 146. The continuous portion 190 may have a larger degree of tapering than the projection 146 (thus, angle $\theta$ would be greater than angle $\theta$). However, in other embodiments, angle $\theta$ may be less than or equal to angle $\theta$.

Additionally, the continuous portion 190 may have a height 191 and the projection 146 may have a height 192. In some embodiments, the height 191 of the continuous portion 190 may be smaller than the height 192 of the projection 146. In other embodiments, the heights 191, 192 may be the same. In other embodiments, the height 191 of the continuous portion 191 may be larger than the height 192 of the projection 146.

When the collar 140 is inserted into the opening 136 of the tooth 130, the tapering prevents the collar 140 from pushing through the other side of the opening 136 and becoming dislodged. The tapering, specifically the tapering of the continuous portion 190, also stabilizes the collar 140 by preventing rotation of the collar. The opening 136 of the tooth 130 biases the pin 150 forward such that the forward section 159 of the pin 150 presses against the forward section 129 of the front opening 127 of the adapter 120. When this happens, a reaction force also presses the continuous portion 190 of the collar 140 towards along the opposite side of the opening 136. The tapering of the continuous portion 190 may distribute the loading, prevent the collar 140 from rotating, and stabilize the fastening assembly 102 and the tooth-and-adapter assembly during use.

Assembly of the system may be accomplished as described herein. In some implementations, the collar 140 is installed in the opening 136 of a wear member, which in the example implementation shown, is the tooth 130. The collar 140 may be inserted from the cavity in the tooth 130 into the inner side of the tooth 130, and into the opening 136 as shown in FIGS. 9 and 10. The sidewalls of the opening 136 may compress the collar locks 160 on the collar 140 as the collar 140 is slid into place. Upon reaching the fully seated position in which the top surface 143 of the collar 140 is in contact with or nearly in contact with the shoulder 184 of the opening 136, the collar locks 160 snap into place in the collar lock holding recesses 138 of the opening 136. In will be appreciated that the collar locks 160 could be installed into the opening 136 and the pockets 138 could be formed into the collar 140. Once snapped into place, the collar locks 260 span across the interface between the outer surfaces of the collar 130 and the sidewalls of the opening 136 in the tooth 130, retaining the collar 140 within the opening 136. This process of installing the collar 140 into the tooth may occur at the time of installing the tooth onto an adapter or may occur at any time prior such as before shipping of the tooth. In this regard, the collar 140 including the collar locks 160 and the pin lock 170 may be assembled with the tooth contemporaneously with manufacturing of the tooth.

The tooth 130 may then be slid over the adapter 120 to the position shown in FIG. 3. In this installed configuration, the opening 127 of the nose and the aperture 141 of the collar 130 are aligned along a common axis. The pin 150 may then be introduced into the aperture 141 and threaded into the aperture 141 with the central axis 194 of the pin 150 aligned with the common axis of the bore, and the end 157 of the pin 150 is advanced into the opening in the adapter 120.

Initially, the end 157 of the pin 150 extends into the opening 136 in the adapter 120 prior to the threads 154 on the pin 150 engaging the threads 144 of the collar 130. However, the pin 150 may not yet be in contact with the adapter 120. As the pin 150 is rotationally threaded into the collar 140, the end 157 advances deeper into the opening 127 the adapter 120. As described herein, the pin 150 is tapered and the angle of the openings 127 in the adapter 120 may be angled to distribute loading along the pin 150. The pin 150 may be rotated until the pin 150 is fully seated in the collar 140, the shaft 193 extending into the opening 127, and the pin lock 170 is engaged with the indentation 155 in the pin 150.

As will be appreciated, the interference caused by the pin 150 prevents the wear member from being removed from the adapter 120 in response to a force that would otherwise tend to pull the wear member forward with respect to the nose.

Figure 13:
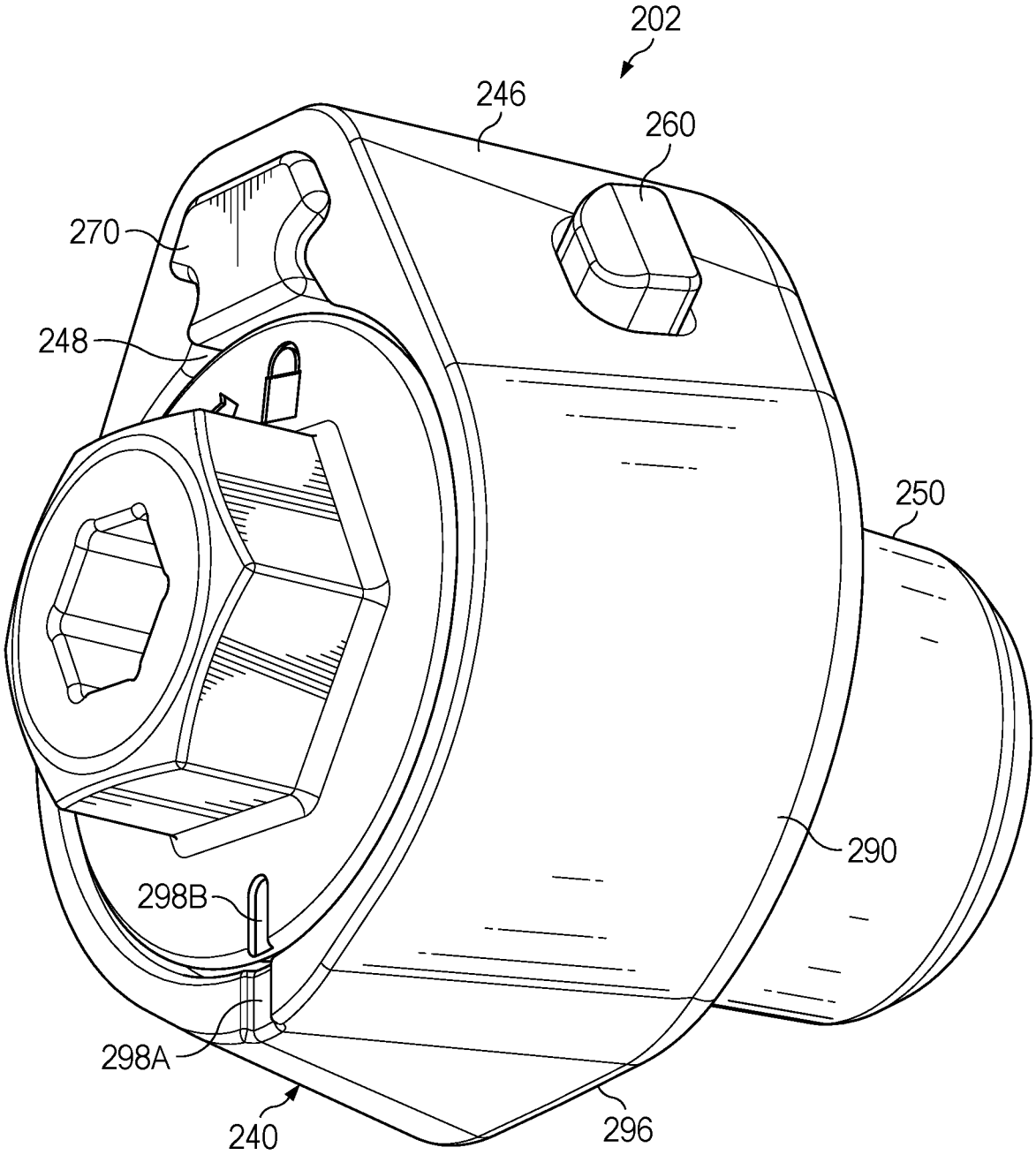
FIG. 13 is a perspective view of a fastening assembly according to an example incorporating principles described herein.
Figure 14:
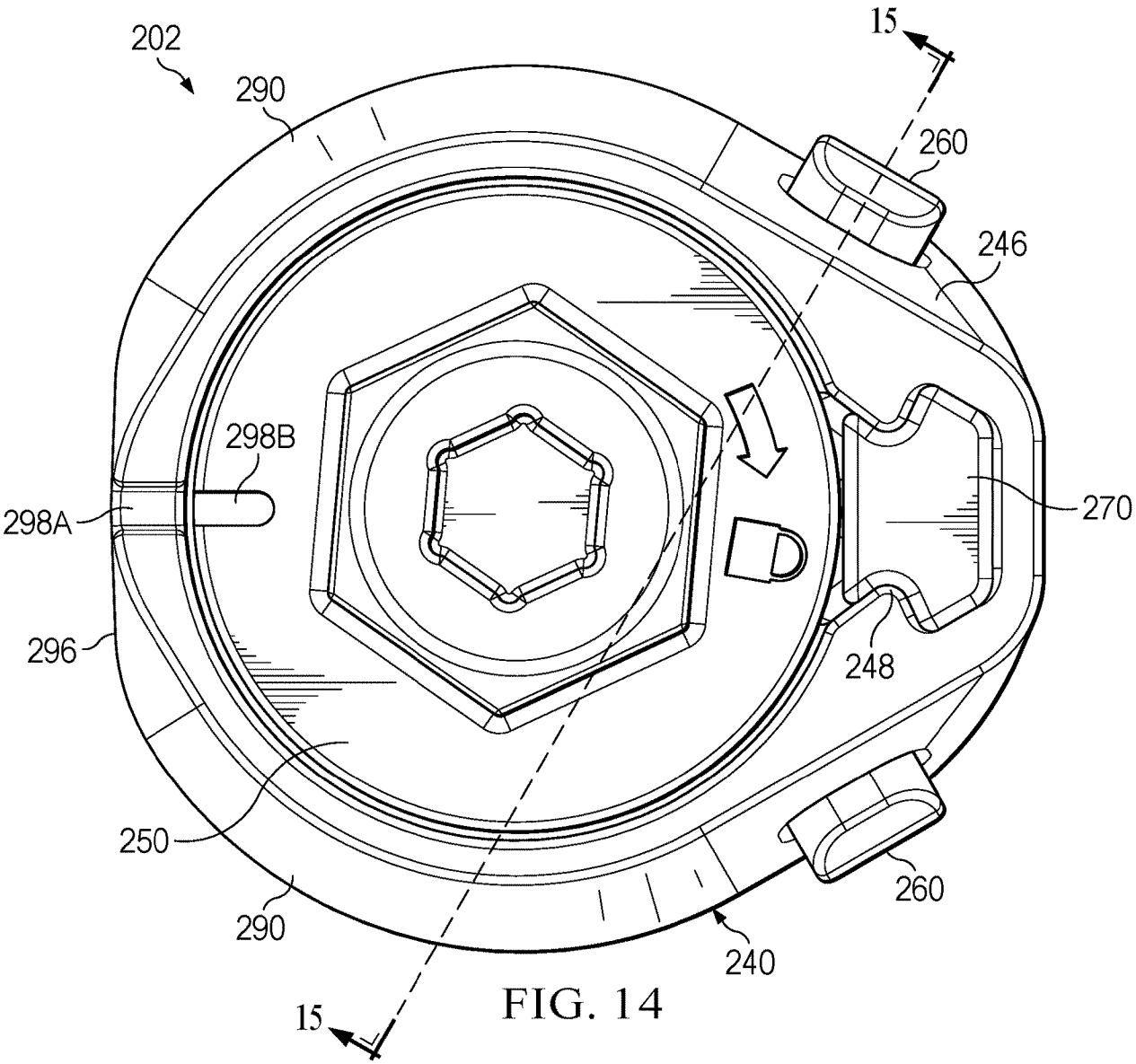
FIG. 14 is a top view of a fastening assembly according to an example incorporating principles described herein.
Figure 15:
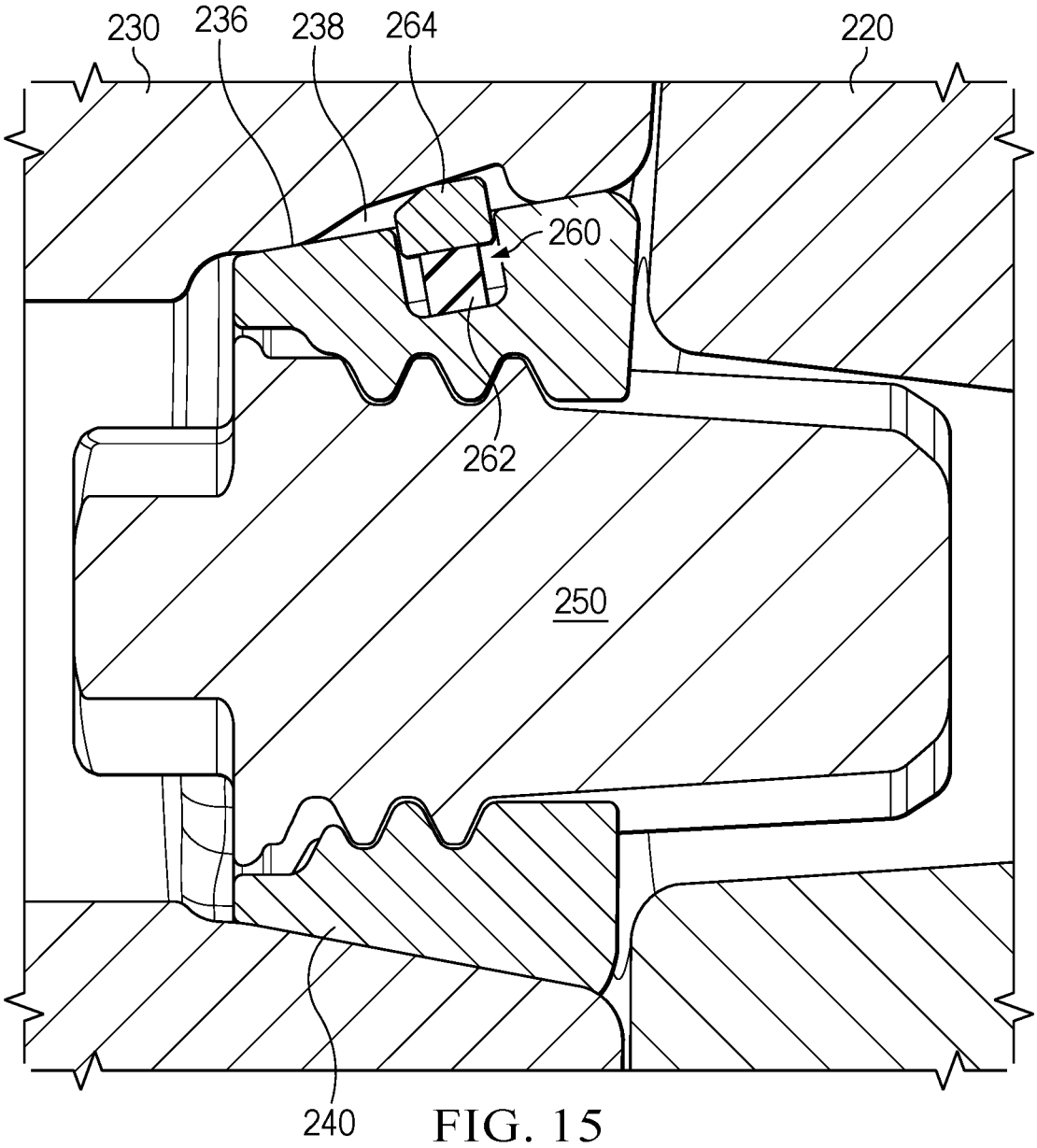
FIG. 15 is a vertical cross-sectional view of a ground engaging assembly including the fastening assembly of FIGS. 13 and 14 according to an example incorporating principles described herein.

FIGS. 13-15 illustrate further examples of a collar and pin fastening assembly including a collar, collar lock(s), a pin, and pin lock(s), etc. for use in the ground engaging assembly 100 according to the present disclosure. FIGS. 13-15 show variations of the embodiments described above. FIGS. 13-15 illustrate an example of a fastening assembly 202. For example, FIG. 13 shows a perspective view of the fastening assembly 202 according to an embodiment of the present disclosure. FIG. 14 shows a top view of the fastening assembly 202 shown in FIG. 13. FIG. 15 shows a vertical cross-sectional view of a ground engaging assembly according to an example incorporating principles described herein. The fastening assembly 202 has many similarities to fastening assembly 102 and some similar features are not repeated in the description of fastening assembly 202 to avoid redundancy. Rather, the description of fastening assembly 202 primarily pertains to additional or different features of fastening assembly 202 as compared to fastening assembly 102. Consistent with fastening assembly 102, the fastening assembly 202 is used to secure a tooth 230 (FIG. 15) or other wear member to an adapter 220 (including an adapter, an intermediate adapter, or a nose) or a nose of the support structure 104 as described herein with reference to FIGS. 1-3.

In some embodiments, collar 240 is a variation of collar 140 described above. Collar 240 contains a perimeter arcing or rounded continuous portion(s) 290, a perimeter projection portion 246 (or a discontinuous portion), and a perimeter flat portion 296. The flat portion 296 may improve pin body stability. The projection portion 246 extends past the continuous portions 290, thereby making the thickness of the projection portion 246 larger than the thickness of the continuous portion(s) 290 and larger than the thickness of the flat portion 296. In some embodiments, the flat portion 296 is positioned on the opposite side of the collar 240 as the projection portion 246. The flat portion 296 can also be positioned adjacent the projection portion 246. When the flat portion 296 is positioned adjacent the projection portion 246, the collar 240 may only have one continuous portion 290. In some embodiments, the collar 240 has more than one flat portions 296. For example, there may be two or more flat portions and the flat portion or portions 296 are not always positioned opposite the projection portion 246.

In some embodiments, not all segments of the flat portion 296 are of equal width across the external surface of the collar 240. For example, the flat portion 296 may be tapered across the external surface of the collar 240 such that the flat portion 296 is wider at one longitudinal edge of the collar 240 than the other longitudinal edge. In some embodiments, the tapering of the flat portion 296 across the external surface of the collar 240 occurs at different degrees than the angle shown in FIGS. 13 and 14. For example, the taper may occur more gradually, thereby increasing the area of the flat portion 296. Alternatively, the taper may occur more acutely, thereby decreasing the total area of the flat portion 296.

The area of the flat portion 296 across the collar 240 is not limited to a tapered pattern. In some embodiments, the area of the flat portion 296 may be irregular or non-uniform. For example, the bounds of the flat portion 296 may vary across the external surface of the collar 240, but in non-tapered pattern. The flat portion 296 may not extend across the entire face of the collar 240 or the bounds of the flat portion 296 may be curved, among other irregular features. In some embodiments, the flat portion 296 may be consistent across the external surface of the collar 240. For example, the flat portion 296 may be of equal width across the collar 240. Increasing the width and surface area of the flat portion 296, regardless of whether the pattern of the flat portion 296 is of regular or irregular shape may increase pin body stability.

In some embodiments, collar lock(s) 260 are a variation of collar locks 160 described above. Collar lock(s) 260 protrude through the exterior of collar lock 240. The collar locks 260 have a head 264 and a compressible base 262. In some embodiments, the shape of head 264 is trapezoidal, as shown in FIG. 15. For example, head 264 has a varying height throughout its cross-section. In some embodiments, the top of head 264 includes a flat surface and a sloped surface. In some embodiments, the sloped surface may slope towards the head of pin 250. The sloped surface on the top of head 264 of collar lock 260 may help to facilitate the decompression of collar lock 260 as collar 240 is inserted into the tooth or other member. Some portions of head 264 may be rounded, for example, the portion containing the sloped surface. Other portions of head 264 may be squared off, for example, the portion of the head 264 with the flat surface. The squared off portion of head 264 having the flat surface may help to ensure that the collar 240 remains secured in the tooth after insertion and after the compressible base 262 has decompressed.

The shape of the collar locks 260 is not limited to the trapezoidal shape shown in FIGS. 13-15 or the elliptical shape of collar locks 160 shown at least in FIGS. 4, 5, and 7. Other trapezoidal configurations are also contemplated. Additionally, the shape may be spherical, cubical, rectangular, pyramidal, pentagonal, or any other shape. The shape of the collar locks 160, 260 need not be regular or symmetric. For example, the collar locks may be irregular and non-symmetric.

In some embodiments, collar lock engagement holes 238 are a variation of the collar lock engagement holes 138 described above. The opening 236 of tooth 230 contains two collar lock engagement holes 238. The collar lock engagement holes 238 are shaped to receive the head 264 of the collar lock 260. The shape of the collar lock engagement holes 238 may change depending on the shape and orientation of the collar locks 260. The head 264 of the collar lock 260 engages with the collar lock engagement hole 238. As the collar 240 is pressed into the opening 236, the surface of the opening 236 presses against the head 264 of the collar lock 260, which compresses the compressive base 262 of the collar lock 260. When the collar lock 260 moves over the collar lock engagement hole 238, the compressive base 264 decompresses to its original shape. The head 264 of the collar lock 260 is then disposed within the collar lock engagement hole 238, locking the collar 240 to the tooth 230. As shown in FIG. 15, the depth of the collar lock engagement hole 238 increases towards the interior of tooth 230, creating a slope or a taper. Unlike the collar lock engagement hole 138, collar lock engagement hole 238 is only tapered on one side, the side towards the exterior of tooth 230. Because the collar lock engagement hole 238 stops abruptly on the side nearest the interior of tooth 230, the collar lock 260 with decompressed base 262 is further prevented from escaping the collar lock engagement hole 238. In FIG. 15, the tooth 230 is received or being secured to an adapter 220 or the nose 110 (FIG. 2).

The orientation of collar locks 260 is not limited to the orientation of collar locks 260 shown at least in FIGS. 13-15 and collar locks 160 shown at least in FIGS. 4, 5, and 7. For example, collar locks 160 and 260 may be oriented in any direction. As shown in FIGS. 13-15, the collar locks 260 are oriented such that the longest dimension of the head 264 is parallel to the longitudinal edges of collar 240. This is different than the orientation of the collar locks 160 shown at least in FIGS. 4, 5, and 7, wherein the longest dimension of the head 164 is perpendicular or otherwise transverse to the longitudinal edges of collar 140. The collar locks 260 may be oriented in any direction with respect to the collar. The orientation of the collar locks 160, 260 may help to insert collar 240 into the tooth and may also help to keep the collar locked to the opening in the tooth after insertion. The orientation and shape of the collar lock 260 will impact the forces needed to insert collar lock 260 into collar 240.

In some embodiments, pin lock 270 is a variation of the pin lock 170 described above. Pin lock 270 locks the pin 250 to the collar 240. The collar 240 has a pin lock holding recess 248 shaped to fit the pin lock 270. As shown, the pin lock 270 may be an irregular shape. The shape of the pin lock 270 may be in the form of an hourglass or a portion of an hourglass. For example, the pin lock 270 may vary in widths at points radially outward from the pin 250. The irregular shape of pin lock 270 may create notches and/or other concave features that the collar 240 extends into. The notches and/or concavities of the pin lock 270 may help to keep the pin 250 locked while the rotatable pin 250 applies force to the plunger attached to pin lock 270. The shape of the pin lock 270 may help to resist the natural forces applied to the pin lock 270 due to the rotational nature of pin 250. The pin lock 270 is not limited to only irregular shapes or the irregular shape shown in FIGS. 13-15. Regular shapes are also contemplated and may be used. Regular shapes can provide similar benefits, for example, a triangular shaped pin lock 270 may increase in width at points radially outward from the pin lock 250. The increasing width of the pin lock 270 at points further and further away from the pin lock 250 prevents the pin lock 270 from escaping pin lock holding recess 248. FIGS. 13 and 14 also show a reference indicator 298A and 298B on the collar 240 and the pin 250, respectively. These are visual indicators to a user indicating when the tip 173 of the plunger 172 is aligned with the pin lock engagement hole 155 on the pin 150 (see FIG. 12) or may indicate other alignment information. The indicators may be formed or shaped into the collar 240 and pin 250, or may be otherwise added as surface markings or indicia.

Persons of ordinary skill in the art will appreciate that the implementations encompassed by the present disclosure are not limited to the particular exemplary implementations described above. In that regard, although illustrative implementations have been shown and described, a wide range of modification, change, combination, and substitution is contemplated in the foregoing disclosure. It is understood that such variations may be made to the foregoing without departing from the scope of the present disclosure. Accordingly, it is appropriate that the appended claims be construed broadly and in a manner consistent with the present disclosure.

What is claimed is:

1. A fastening assembly for securing a wear member, comprising:

a collar having an exterior surface, comprising:

an aperture;

a lock holding recess in the exterior surface;

a collar lock coupled to the lock holding recess and projecting from the exterior surface of the collar, the collar lock being elastically deformable inward while introducing the collar to a wear member and engageable with a collar lock engagement hole in an opening of the wear member to hold the collar within the opening of the wear member, wherein the collar lock comprises:

an elastic base coupled to the lock holding recess; and a head coupled to the elastic base such that the head projects at least partially outwardly beyond the exterior surface of the collar; and a pin lock disposed on a portion of the aperture; and a pin shaped to be inserted into the aperture of the collar, the pin having a pin lock engagement hole shaped to engage with the pin lock.

2. The fastening assembly of claim 1, wherein the collar comprises a projection forming a part of the exterior surface, the projection having a surface angled relative to a longitudinal axis at a different angle than an opposing portion of the exterior surface.

3. The fastening assembly of claim 2, wherein the collar comprises a first collar lock located on a first side of the projection and a second collar lock located on a second side of the projection.

4. The fastening assembly of claim 2, wherein a height of the collar at the projection is greater than a height of the opposing portion of the exterior surface.

5. The fastening assembly of claim 2, wherein the pin lock is aligned with the projection.

6. The fastening assembly of claim 1, wherein the exterior surface comprises a flat region, the collar lock being disposed on the flat region.

7. The fastening assembly of claim 1, wherein the aperture of the collar is biased towards a leading end of the wear member.

8. A fastening assembly for securing a wear member, comprising:

a collar configured to be secured in the wear member, the collar having a cavity-facing end, an outwardly facing end, and an outer surface extending between the cavity-facing end and the outwardly facing end, the collar tapering from the cavity-facing end to the outwardly facing end, the collar comprising:

an aperture defining a longitudinal axis;

a lock holding recess in the outer surface;

a collar lock coupled to the lock holding recess and projecting from the outer surface of the collar, the collar lock being elastically deformable inward while introducing the collar to a wear member and engageable with a collar lock engagement hole in an opening of the wear member to hold the collar within the opening of the wear member, wherein the collar lock comprises:

an elastic base coupled to the lock holding recess; and a head coupled to the elastic base such that the head projects at least partially outwardly beyond the outer surface of the collar; and a pin lock disposed in the collar and projecting into the aperture, the pin lock comprising a compressible body and a plunger that projects into the aperture; and, a threaded pin shaped to fit into the aperture, the pin having a pin lock engagement hole for engaging with the pin lock.

9. The fastening assembly of claim 8, wherein the collar comprises a projection forming a part of the outer surface, the projection having a surface angled relative to the longitudinal axis at a different angle than an opposing portion of the outer surface.

10. The fastening assembly of claim 9, wherein the collar comprises a first collar lock located on a first side of the projection and a second collar lock located on a second side of the projection.

11. The fastening assembly of claim 9, wherein a height of the projection is greater than a height of the opposing portion of the outer surface.

12. The fastening assembly of claim 9, wherein the pin lock is aligned with the projection.

13. The fastening assembly of claim 8, wherein the outer surface comprises a flat region, the collar lock being disposed on the flat region.

14. The fastening assembly of claim 9, wherein the aperture of the collar is biased towards a leading end of the wear member.

15. The fastening assembly of claim 8, wherein the collar is asymmetrical about the longitudinal axis.

* * * * *